US008500262B2

(12) United States Patent
Ueda et al.

(10) Patent No.: US 8,500,262 B2
(45) Date of Patent: Aug. 6, 2013

(54) INKJET RECORDING DEVICE

(75) Inventors: Masato Ueda, Akishima (JP); Katsuaki Komatsu, Hachioji (JP); Masahiro Makita, Tachikawa (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 74 days.

(21) Appl. No.: 13/122,599

(22) PCT Filed: Sep. 24, 2009

(86) PCT No.: PCT/JP2009/066499

§ 371 (c)(1),
(2), (4) Date: Apr. 5, 2011

(87) PCT Pub. No.: WO2010/041553

PCT Pub. Date: Apr. 15, 2010

(65) Prior Publication Data

US 2011/0187801 A1 Aug. 4, 2011

(30) Foreign Application Priority Data

Oct. 8, 2008 (JP) ..... 2008-261413
May 12, 2009 (JP) ..... 2009-115336

(51) Int. Cl.
*B41J 2/19* (2006.01)

(52) U.S. Cl.
USPC ..... 347/92; 347/85; 347/87

(58) Field of Classification Search
USPC ..... 347/84–93
See application file for complete search history.

(56) References Cited

U.S. PATENT DOCUMENTS

| | | | |
|---|---|---|---|
| 5,408,257 | A | 4/1995 | Hiramatsu et al. |
| 6,116,727 | A | 9/2000 | Hagiwara |
| 6,325,496 | B1 | 12/2001 | Kageyama et al. |
| 7,097,287 | B2 | 8/2006 | Nakao et al. |

(Continued)

FOREIGN PATENT DOCUMENTS

| | | | |
|---|---|---|---|
| EP | 1 577 096 | A1 | 9/2005 |
| EP | 1 911 593 | A2 | 4/2008 |

(Continued)

OTHER PUBLICATIONS

International Search Report dated Oct. 27, 2009 issued in International Appln. No. PCT/JP2009066499.

(Continued)

*Primary Examiner* — Ellen Kim
(74) *Attorney, Agent, or Firm* — Holtz, Holtz, Goodman & Chick, PC

(57) ABSTRACT

An inkjet recording device, wherein air can be retained in an ink supply pipe by using a simple structure without applying substantial changes to the inkjet recording device, a variation in an ink supply pressure is mitigated by the retained air, and ink can be ejected with high stability. An inkjet recording device is provided with an inkjet head for ejecting ink, an ink flow path for supplying the ink, which is supplied from an ink supply source, to a pressure chamber of the inkjet head and having at least a portion thereof constructed from an ink supply pipe, and an air retaining member inserted in the ink supply pipe, with the ink allowed to pass through the air retaining member, and retaining air in at least a portion of a space formed between the air retaining member and the inner surface of the ink supply pipe.

17 Claims, 10 Drawing Sheets

U.S. PATENT DOCUMENTS

| | | | |
|---|---|---|---|
| 2003/0117466 | A1 | 6/2003 | Usui et al. |
| 2003/0231230 | A1 | 12/2003 | Shimamoto et al. |
| 2004/0027427 | A1 | 2/2004 | Tominaga |
| 2005/0206691 | A1 | 9/2005 | Takata et al. |
| 2008/0084464 | A1 | 4/2008 | Saga et al. |
| 2008/0143763 | A1 | 6/2008 | Sakurai |

FOREIGN PATENT DOCUMENTS

| | | | |
|---|---|---|---|
| JP | 61-112648 | A | 5/1986 |
| JP | 4-26730 | U | 3/1992 |
| JP | 4-98143 | U | 8/1992 |
| JP | 5-016382 | A | 1/1993 |
| JP | 6-344558 | A | 12/1994 |
| JP | 9-136415 | A | 6/1997 |
| JP | 11-010911 | A | 1/1999 |
| JP | 2000-158668 | A | 6/2000 |
| JP | 2000-309109 | A | 11/2000 |
| JP | 2001-113724 | A | 4/2001 |
| JP | 2005-103453 | A | 4/2005 |
| JP | 2005-271553 | A | 10/2005 |
| JP | 2005271553 | A * | 10/2005 |
| JP | 2005324358 | A * | 11/2005 |
| JP | 2006-130682 | A | 5/2006 |
| JP | 2006-231771 | A | 9/2006 |
| JP | 2006-315360 | A | 11/2006 |
| JP | 2008-126646 | A | 6/2008 |
| WO | WO 02/090117 | A1 | 11/2002 |

OTHER PUBLICATIONS

Extended European Search Report (EESR) dated May 16, 2012 (in English) in counterpart European Application No. 09819088.7.

Japanese Office Action drafted Jul. 20, 2012 (and English translation thereof) in counterpart Japanese Application No. 2010-532871.

Chinese Office Action dated Mar. 11, 2013 (and English translation thereof) in counterpart Chinese Application No. 200980139058.1.

* cited by examiner

INKJET RECORDING DEVICE

This is a U.S. National Phase Application under 35 U.S.C. 371 of International Application PCT/JP2009/066499, filed on Sep. 24, 2009. This application claims the priority of Japanese Application No. 2008-261413 filed on Oct. 8, 2008, and Japanese Application No. 2009-115336 filed on May 12, 2009, the entire contents of which are incorporated herein by reference.

TECHNICAL HELD

The present invention relates to an inkjet recording device.

BACKGROUND

Conventionally, inkjet recording devices to record given images on recording media such as sheets or plastic thin plates by ejecting ink have been proposed and put into practical use. An inkjet recording device is provided with an inkjet head (hereinafter referred to also as a head) having a nozzle. As such an inkjet head is allowed to move in a predetermined direction, ink is ejected from the nozzle toward a recording medium, whereby a given image is recorded on the recording medium.

Incidentally, in some cases, an ink used for the above inkjet recording device is supplied to a head located in a carriage from an ink supply container via an ink supply pipe.

In this ink supply mechanism, since the carriage in which a head is mounted is scanned, the pressure of an ink supplied to the head is varied by acceleration/deceleration and vibration. In this case, the ink meniscus position of the nozzle of the head is shifted, whereby problems are produced in which density non-uniformity is produced and in the worst case, the meniscus is broken, resulting in the impossibility of ejection.

Further, as a countermeasure against such phenomena, conventionally, a constitution is proposed in which a damper is arranged in the upstream of a head as shown in Patent Document 1 to absorb pressure variation during ink supply.

In Patent Document 1, an inkjet recording device is disclosed in which air chambers are provided in the ink inflow pipeline for the head and the ink outflow pipeline channel to provide a damper function.

Still further, there are proposed those in which an air chamber is arrange inside the head to provide a damper function (for example, refer to Patent Documents 2-4).

In Patent Document 2, an inkjet head is disclosed in which a plurality of air chambers adjacent to a common ink chamber of the head to retain gas in the interior are provided to provide a damper function. Further, in Patent Document 3, an inkjet head is disclosed in which an air chamber adjacent to a common ink chamber of the head to retain air absorbing pressure variation traveling in an ink inside the common ink chamber is provided. In Patent Document 4, an inkjet head is disclosed in which an opening and closing valve adjacent to a common ink chamber of the head to open and close an air chamber and an air vent communicatively connected via the air chamber is provided.

PRIOR ART DOCUMENTS

Patent Documents

Patent Document 1: Unexamined Japanese Patent Application Publication (hereinafter referred to as JP-A) No. 11-10911

Patent Document 2: JP-A No. 9-136415

Patent Document 3: JP-A No. 6-344558

Patent Document 4: JP-A No. 2006-315360

BRIEF DESCRIPTION OF THE INVENTION

Problems to be Solved by the Invention

However, in the above conventional damper structure, since a step to connect an air chamber and an ink supply pipe and a step to provide an air chamber adjacent to a common ink chamber of the head are required and the structure becomes complicated, a large constitutional change is required for an inkjet recording device, whereby cost increase and reliability degradation may result.

Further, in any of the methods described in the patent documents, in an inkjet recording device having an inkjet head and an ink supply pipe, further addition of an air chamber has produced a problem to be solved in which difficulty is further produced in production.

An object of the present invention is to solve the above problems and to provide an inkjet recording device in which with a simple structure and no large constitutional change of an inkjet recording device, air can be retained in an ink supply pipe and the variation of the supply pressure of an ink is reduced by the retained air to enhance ejection stability.

Means to Solve the Problems

The problems of the present invention are solved by the following constitution.

1. An inkjet recording device comprising: an inkjet head to eject an ink in a pressure chamber; an ink supply path to supply an ink from an ink supply source to the pressure chamber of the inkjet head in which at least a part of the ink supply path is constituted of an ink supply pipe; and an air retaining member to be inserted in an interior of the ink supply pipe in a state where an ink can be communicatively connected to retain air in at least a part of a space formed between an inner surface of the ink supply pipe and the air retaining member.

2. The inkjet recording device, described in item 1, in which the air retaining member comprises a contact portion for making contact with the inner surface of the ink supply pipe.

3. The inkjet recording device, described in item 2, in which at least either of the ink supply pipe and the air retaining member is constituted of a material which can be deformed with the insertion of the air retaining member.

4. The inkjet recording device, described in item 2 or 3, in which a groove portion communicatively connected to the space is formed in the contact portion; an atmospheric air communication hole to communicatively connect the space to the atmosphere via the groove portion is formed at a position corresponding to the groove portion in the ink supply pipe; and the inkjet recording device further comprises an opening and closing member for opening and closing the atmospheric air communication hole.

5. The inkjet recording device, described in any of items 1-4, in which at least the portion of the ink supply pipe making contact with the air exhibits air permeability.

6. The inkjet recording device, described in any of items 1-5, in which at least the portion of the ink supply pipe making contact with the air is transparent.

7. The inkjet recording device, described in any of items 1-6, in which the face of the ink supply source side of the space is closed and the face of the pressure chamber side is open.

8. The inkjet recording device, described in item 7, in which in the posture during use of an inkjet recording device, the face of the ink supply source side is located above the face of the pressure chamber side.

9. The inkjet recording device, described in any of items 1-8, in which the space is provided with a spirally formed portion.

10. The inkjet recording device, described in any of items 1-9, in which the space is provided with a circularly formed portion.

11. The inkjet recording device, described in any of items 1-10, in which the space is provided with a first area and a second area which is located closer to the pressure chamber side than the first area and having a small channel cross-sectional area.

12. The inkjet recording device, described in any of items 1-11, in which the air retaining member is extended in an axis direction of the ink supply pipe and provided with a penetrated hole in which an ink can be communicatively connected.

13. The inkjet recording device, described in any of items 1-12, in which the air retaining member is provided with a large diameter section making contact with the inner surface of the ink supply pipe and a small diameter section having a smaller diameter than the large diameter section, and the space is formed between the inner surface of the ink supply pipe and the small diameter section.

14. The inkjet recording device, described in item 13, in which at least one large diameter section described above is located closer to the ink supply source than the small diameter section to close the face of the ink supply source side of the space.

15. The inkjet recording device, described in item 14, in which the air retaining member is provided with a second large diameter section which is located closer to the pressure chamber side than the small diameter section and brought into contact with the inner surface of the ink supply pipe; a part of the surface of the second large diameter section making contact with the inner surface of the ink supply pipe is provided with a groove portion extending in the axis direction of the ink supply pipe; and the first area is formed between the inner surface of the ink supply pipe and the small diameter section and the second area is formed between the inner surface of the ink supply pipe and the groove portion.

16. The inkjet recording device, described in item 13 or 14, in which the small diameter section is provided with a protrusion protruding from a wall surface opposed to the inner surface of the ink supply pipe; the first area is formed between the inner surface of the ink supply pipe and the wall surface; and the second area is formed between the inner surface of the ink supply pipe and the protrusion.

17. The inkjet recording device, described in any of items 13-16, in which the air retaining member is provided with a taper portion gradually contracting from the large diameter section toward the ink supply source side.

18. The inkjet recording device, described in any of items 1-17, in which the air retaining member is inserted in the vicinity of the inkjet head in an inkjet supply pipe one end of which is connected to the inkjet head.

19. The inkjet recording device, described in item 18, in which the inkjet head can be reciprocated in a predetermined direction and the air retaining member is inserted in a portion of an ink supply pipe the one end of which is connected to the inkjet head in which the portion is extended in a direction differing from the predetermined direction from the one end.

20. The inkjet recording device, described in item 18 or 19, in which the inkjet recording device further comprising a fixing section for fixing an ink supply pipe the one end of which is connected to an inkjet head to the inkjet head or to a mounting section in which the inkjet head is mounted; and wherein the air retaining member is inserted between the one end and a portion fixed by the fixing section in the ink supply pipe.

21. The inkjet recording device, described in any of items 1-20, in which the inkjet recording device further comprising: a damper having a reservoir provided on the way to the ink supply path to temporarily accumulate an ink and a damper film exhibiting flexibility provided for at least one side of the reservoir, and wherein the air retaining member is inserted in the interior of an ink supply pipe constituting at least a part of an ink supply path to supply an ink from the damper to the pressure chamber of the inkjet head.

Effects of the Invention

According to the present invention, there can be provided an inkjet recording device in which with a simple structure and no large constitutional change of an inkjet recording device, air can be retained in an ink supply pipe and the variation of the supply pressure of an ink is reduced by the retained air to enhance ejection stability.

DESCRIPTION OF THE PREFERRED EMBODIMENTS

The preferred embodiments of the present invention will now be described with reference to the drawings. Herein, the following description relates to the preferred embodiments of the present invention that by no means limit the scope of the present invention.

First Embodiment

Figure 1:
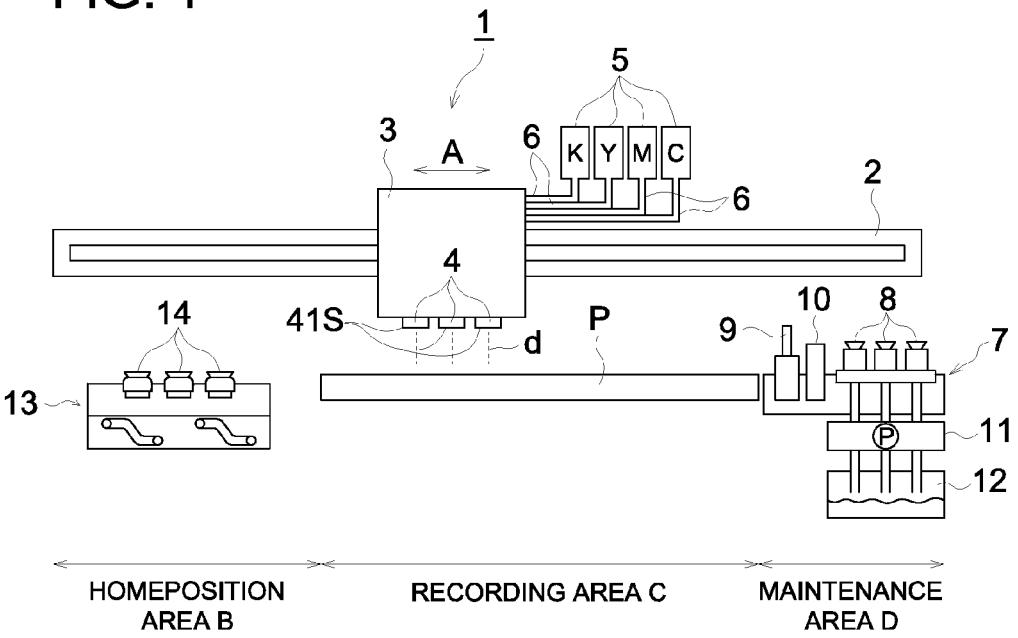
FIG. 1 is a schematic front view of an inkjet recording device according to a first embodiment of the present invention.

Initially, with reference to FIG. 1, the entire constitution of an inkjet recording device of the first embodiment of the present invention will now be described. FIG. 1 is an entire constitutional view of the inkjet recording device according to the first embodiment of the present invention.

The inkjet recording device 1 ejects an ink to a recording medium P to record an image on the recording medium P. The inkjet recording device 1 is provided with an unshown conveyance member. This conveyance member conveys a recording medium P in the vertical scanning direction perpendicular to the main scanning direction A as the recording medium P is passed through the recording area C.

Above the recording area C, a carriage rail 2 extending in the main scanning direction A (the horizontal direction) is arranged. This carriage rail 2 is provided with a carriage 3 guided by the carriage rail 2 so as to be movable.

An inkjet head 4 to eject an ink to a recording medium P is mounted in the carriage 3, which is moved from the home position area B to the maintenance area D along the carriage rail 2 in the arrow A direction.

During this main scanning, the inkjet head 4 ejects an ink d to a recording medium P to form an image on the recording medium P. In the present embodiment, main scanning is carried out in the horizontal direction, and an inkjet head 4 is placed so that the ink ejection direction from the nozzle is allowed to be the downward direction in the vertical direction.

In the inkjet recording device 1 of the present embodiment, 4 inkjet heads 4 are placed in a carriage 3 in total to eject 4 color inks of black (K), yellow (Y), magenta (M), and cyan (C). In FIG. 1, 3 inkjet heads 4, 4, and 4 are arranged in a line in the arrow A direction. On the back side (the back side in the perpendicular direction of the sheet plane) of the center inkjet head 4 among the inkjet heads 4, 4, and 4 lined up in this arrow A direction, another inkjet head 4 (not shown) is arranged.

Each inkjet head 4 described above is connected to an ink tank 5 to store an ink of each color of black, yellow, magenta, and cyan via an individual ink supply pipe 6. In other words, an ink inside the ink tank 5 is supplied to each inkjet head 4 by an ink supply pipe 6. Namely, in the present embodiment, the ink tank 5 is equivalent to an ink supply source.

The ink supply pipe 6 of the present embodiment contains a first linear portion extending in the vertical direction differing from the main scanning direction A (the horizontal direction), a second linear portion extending in the main scanning direction A, and a third linear portion extending in the vertical direction differing from the main scanning direction A which is connected to the inkjet head 4 (refer to FIG. 4). Although not shown, the connection portion of the first linear portion and the second linear portion is arc-shaped to follow the movement of the carriage 3.

In the maintenance area D, a maintenance unit 7 is provided to maintain an inkjet heads 4. This maintenance unit 7 is provided with a plurality of suction caps 8 to cover the ejection surface 41S of the inkjet head 4 in order to suction an ink in the nozzle, a cleaning blade 9 to wipe an ink having adhered to the ejection surface 41S, an ink receiver 10 to receive an ink having been subjected to blank ejection, a suction pump 11, and a discarded ink tank 12.

The suction cap 8 is communicatively connected to the discarded ink tank 12 via the suction pump 11, and covers the ejection surface 41S of an inkjet head 4 by moving up during a maintenance operation. Four suction caps 8, 8, . . . are arranged each corresponding to the inkjet heads 4 to cover the ejection surfaces 41S of all the inkjet heads 4 when moving up as described above.

The suction pump 11 incorporates a cylinder pump or a tube pump. The suction cap 8 is operated in the state of covering the ejection surface 41S, whereby suction force is generated to suction an ink inside the inkjet head 4 from the nozzle together with foreign material.

In the home position area B, a moisturizing unit to moisturize an inkjet head 4 is provided. In the moisturizing unit 13, 4 moisturizing caps 14 are provided to moisturize an ink of the inkjet head 4 by covering the ejection surface 41S when the inkjet head 4 stands ready. These 4 moisturizing caps 14, 14, . . . are arranged corresponding to the arrangement of the inkjet heads 4 to simultaneously cover the ejection surfaces 41S of the 4 inkjet heads 4.

The control section incorporates a CPU (a central processing unit) and a memory to control each constituent element of the inkjet recording device 1. In the memory, data of images to be formed on recording media P and a program to control each constituent element of the inkjet recording device 1 are memorized. Based on the image data and the program in the memory, a control signal is transmitted to each constituent element.

Next, with reference to FIG. 2 and FIG. 3, the inkjet head 4 according to the present invention will now be described.

Figure 2:
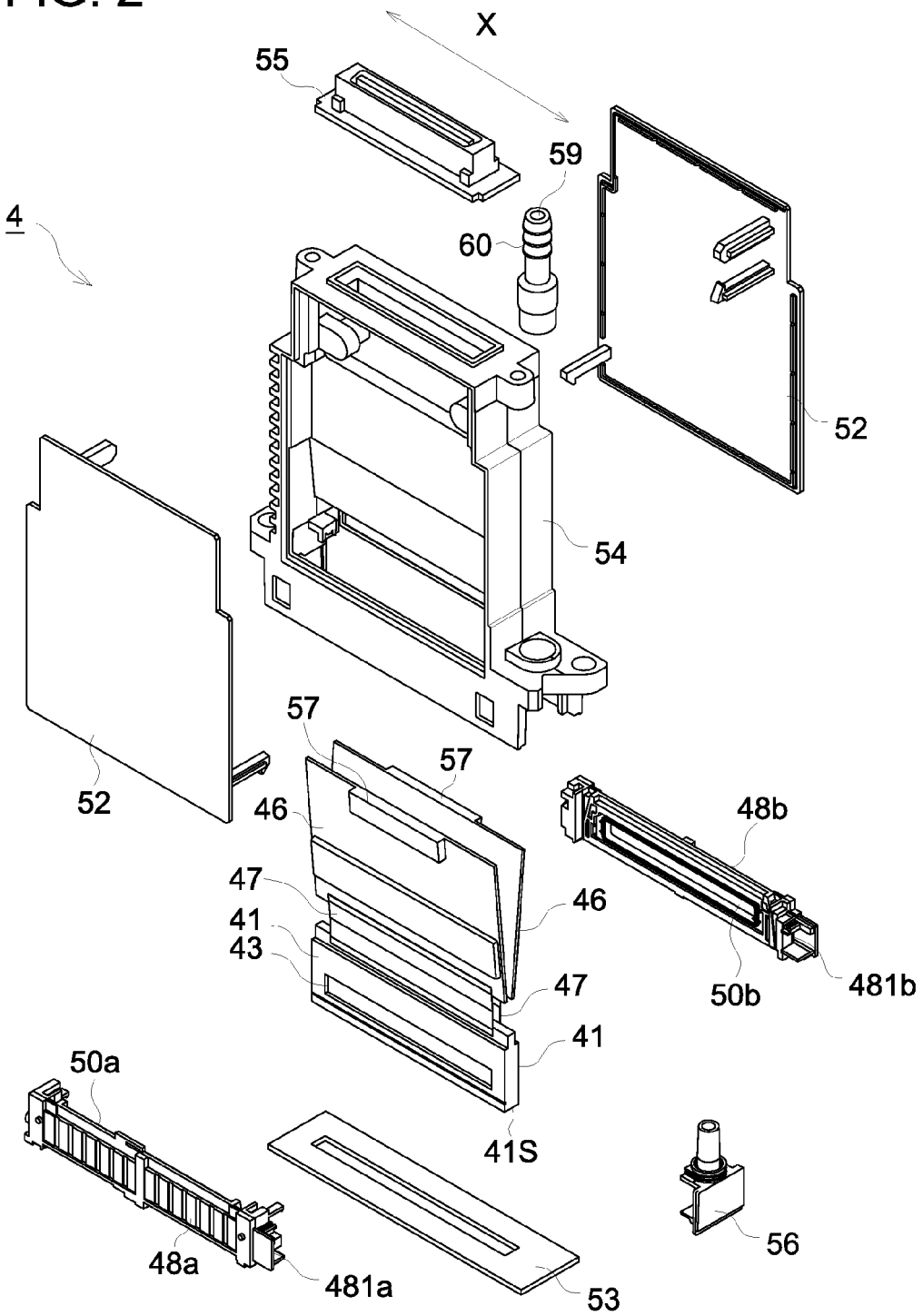
FIG. 2 is an exploded perspective view of an inkjet head according to the first embodiment of the present invention.
Figure 3:
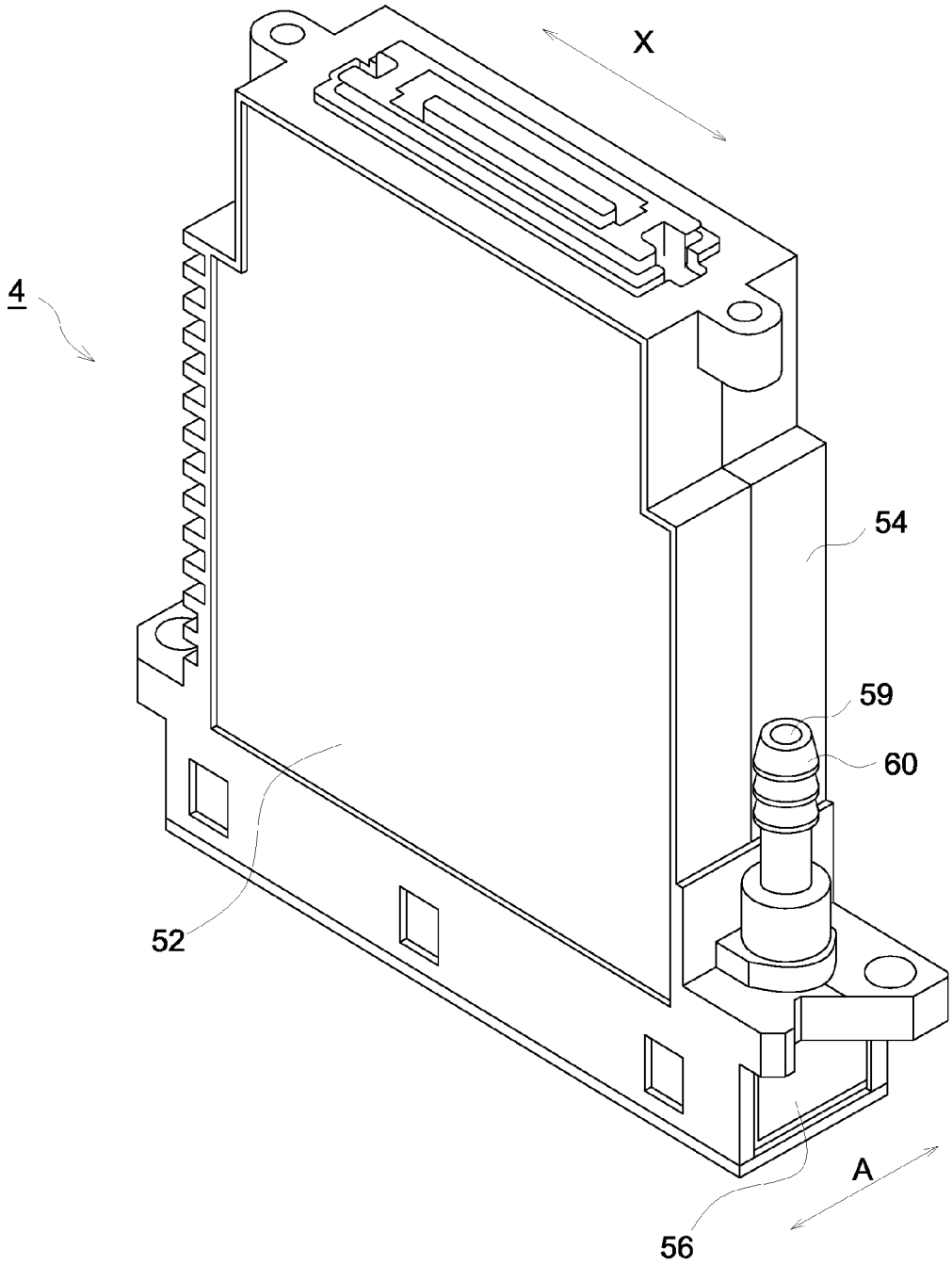
FIG. 3 is a perspective view of the inkjet head of the first embodiment of the present invention.

FIG. 2 is an exploded perspective view of an inkjet head 4 of black (K) among inkjet heads 4 of 4 colors of black (K), yellow (Y), magenta (M), and cyan (C). FIG. 3 is a perspective view of the state of being assembled. Herein, since the same constitution is employed for the inkjet heads 4 of other colors, description thereof will be omitted.

In the inkjet head 4 of the present embodiment, 2 inkjet head chips (hereinafter referred to as "head chips") 41 to eject an ink are placed in a stack. The head chip 41 has an elongated shape, and in the ejection surface 41S thereof, a large number of nozzles (not shown) are arranged (hereinafter, the nozzle arrangement is referred to as the "nozzle line"). The inkjet head 4 of the present embodiment is provided with 2 nozzle lines. The inkjet head 4 is mounted in the carriage 3 so that the arrow X direction (the nozzle line direction) is perpendicular to the main scanning direction A shown in FIG. 1.

In this manner, in the head chip 41, a plurality of nozzles and a plurality of pressure chambers placed corresponding to a plurality of the nozzles are provided by being arranged in the arrow X direction. In the head chip 41, the surface extending in the arrangement direction of these pressure chambers is referred to as the side surface.

Further, in each outer side surface of the stacked 2 head chips 41, an ink supply opening 43 which is almost squareshaped is provided, whereby the ink supply opening 43 and the nozzle are communicatively connected together via an ink ejection channel (not shown) formed in the head chip 41. In a part of the ink ejection channel, a pressure chamber is formed, and thereby a structure is made in which via the action of an unshown piezoelectric element, pressure is allowed to vary to eject ink droplets from the nozzle. In the head chip 41, each of 2 sets of head drive substrates 46 and connectors 57 to transmit a control signal from the control section to each piezoelectric element is connected to the each piezoelectric element via a flexible wiring board 47.

Two sets of a manifold 48*a* and a manifold 48*b* to supply an ink from the outside to the head chips 41 are attached to both sides of the 2 head chips 41. The manifold 48*a* and the manifold 48*b* are made of a material exhibiting ink resistance in which a depression is formed to form common ink chambers 50*a* and 50*b*. In end portions of the manifold 48*a* and the manifold 48*b*, injection openings 481*a* and 48 lb to allow an ink to flow in the common ink chambers 50*a* and 50*b* are provided.

The symbol 60 represents a cylindrical ink supply connecting section serving as an ink introduction opening connected to an ink supply pipe 6 by being mounted in the side portion of the housing frame 54, being connected to the connecting section 56 communicatively connected to the injection openings 481*a* and 481*b*.

The connecting section 56 is a plate-like member of a Japanese katakana character "ko" shape, and in the side portion, a cylindrical connecting section to be connected to the ink supply connecting section 60 is provided, and the connecting section 56 is engaged in the side portion of the housing frame 54 to form an ink supply path in the interior.

As shown in FIG. 2, a holding plate 53 to hold the manifold 48*a*, the manifold 48*b*, and the head chips 41 is attached to the lower portion of the head chips 41 so as for the nozzle surface to be exposed.

Further, a housing frame 54 is provided in which the constituent elements of the inkjet head 4 such as the above head chips 41, the manifold 48*a*, the manifold 48*b*, the head drive substrate 46, and the holding plate 53 are attached and fixed to an inkjet head 4. This housing frame 54 is covered with a cover 52. A connector supporting section 55 is attached to the upper portion of the housing frame 54.

Next, the ink channel during ink injection will now be described.

When an ink is supplied via an ink supply pipe 6 from an ink tank 5, inside an inkjet head 4, initially, the ink is passed trough the ink supply path 59 of the ink supply connecting section 60 and then allowed to flow in the connection section 56, followed by being branched into the injection openings 481*a* and 481*b* of the manifold 48*a* and the manifold 48*b* each to enter the common ink chambers 50*a* and 50*b*. The ink having reached the common ink chambers 50*a* and 50*b* enters the head chip 41 from the ink supply opening 43.

Next, the operation of the inkjet recording device 1 during image formation will now be described.

When the inkjet recording device 1 is powered on, power feeding is carried out for each section of the inkjet recording device 1.

Thereafter, when an initiation instruction for image recording is input, reciprocating scanning of the carriage 3 is initiated. At the same time, the control section transmits a control signal based on image data to the head drive substrate 46 and other drive sections to initiate image recording. On a recording medium P conveyed by the conveyance member, an ink is ejected from the inkjet head 4 to form an image.

Then, at the timing of maintenance to recover the ejection state of the inkjet head 4, the control section controls each section to maintain the inkjet head 4. For details, the control section controls the scanning motor in response to the maintenance timing and moves the carriage 3 to the position where the inkjet head 4 and the suction cap 8 face each other. When the inkjet head 4 and the suction cap 8 have faced each other, the control section controls an elevation motor, whereby the maintenance unit 7 is moved up until the ejection surface 41S of the inkjet head 4 and the suction cap 8 are brought into close contact.

After the completion of elevation of the maintenance unit 7, the control section controls the suction pump 11 for a predetermined time to suction the interior of the suction cap 8.

With the operation of the suction pump 11, the interior of the inkjet head 4 has negative pressure. The ink supply pipe 6 of the upstream side of the inkjet head 4 also has negative pressure, whereby an ink inside the ink supply pipe 6 flows in the inkjet head 4.

The inkjet recording device of the present invention is characterized by having an inkjet head to eject an ink in a pressure chamber; an ink supply path, at least a part of which is constituted of an ink supply pipe, to supply an ink from an ink supply source to the pressure chamber of the inkjet head; and an air retaining member in which an ink is inserted in the interior of the ink supply pipe in the state of being communicatively connected and air is retained in at least a part of a space formed between the inner surface of the ink supply pipe and the air retaining member. In the present embodiment, in the interior of an ink supply pipe 6, an air retaining member is inserted.

Air retained in at least a part of such a space makes it possible to reduce the variation of the supply pressure of an ink due to exterior vibration resulting from a motor and a pump and carriage scanning to enhance ejection stability. At the same time, since an air retaining member needs only to be inserted in an ink supply pipe and also an ink supply pipe and an inkjet head can be used as such, a space can be provided simply at reduced cost with no large constitutional change of an inkjet recording device.

With reference to FIG. 4, an air retaining member according to the present invention will now be described.

Figure 4B:
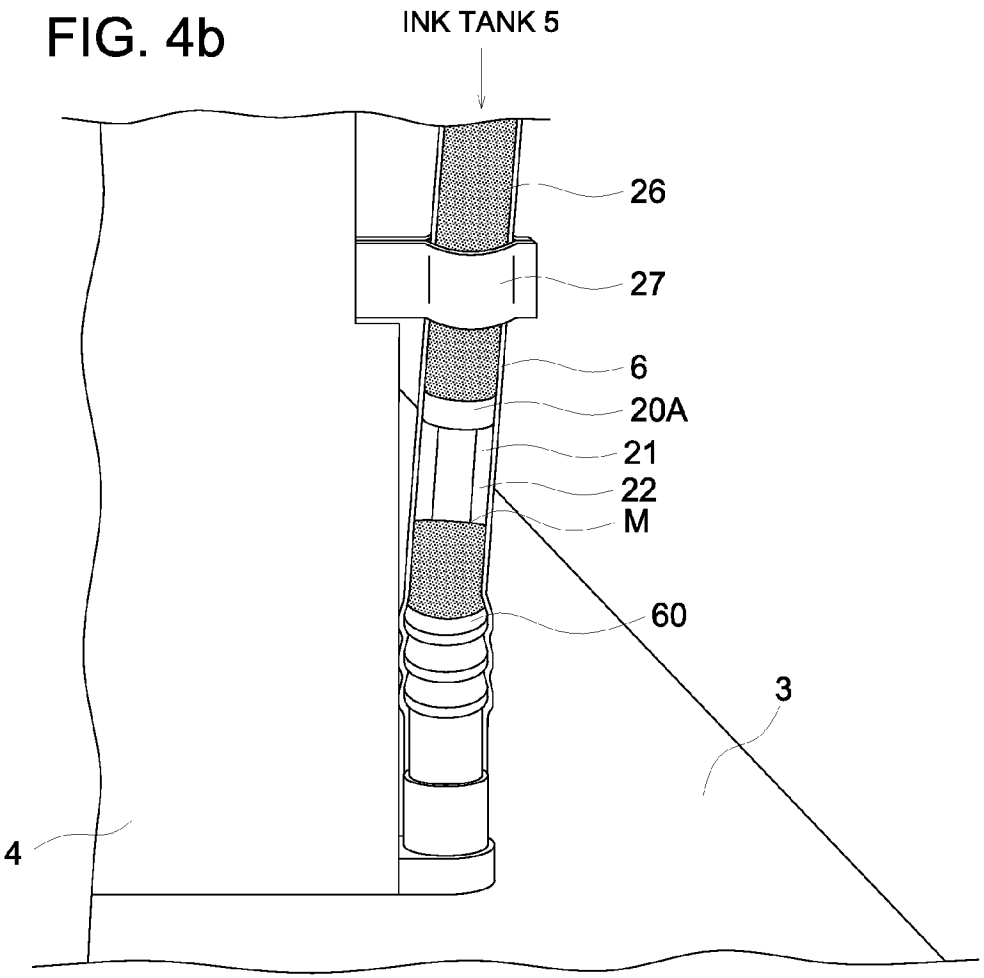
FIG. 4 is a schematic view of an air retaining member according to the first embodiment of the present invention, in which (a) is an enlarged perspective view and (b) is a perspective view showing the state where an inkjet supply pipe in which an air retaining member is inserted has been attached to an inkjet head.
Figure 4A:
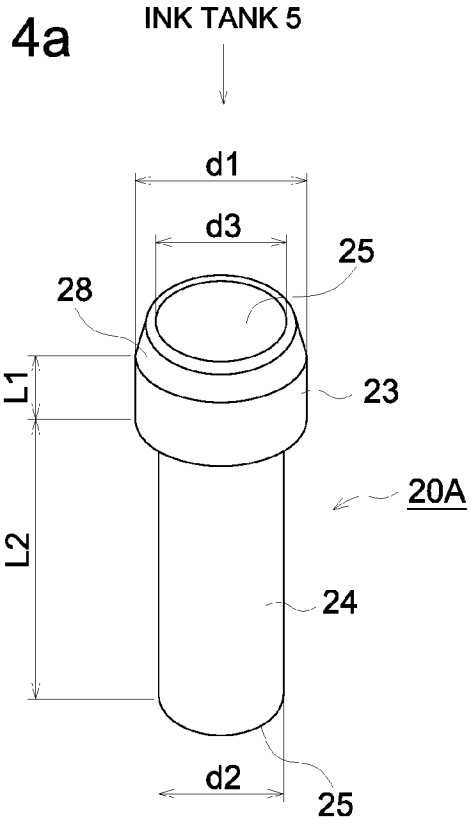

FIG. 4A is an enlarged perspective view of an air retaining member 20A of the first embodiment. FIG. 4B is a schematic perspective view showing the state where an inkjet supply pipe 6 having an inserted air retaining member 20A was attached to the ink supply connecting section 60 of an inkjet head 4 and then an ink 26 has been just supplied.

As shown in FIG. 4B, in the interior of the ink supply pipe 6, the air retaining member 20A is inserted, and a space 22 enabling to retain air 21 in at least a part thereof is formed between the inner surface of the ink supply pipe 6 and the air retaining member 20A.

The air retaining member 20A is constituted of a metal such as stainless steel having excellent ink impermeability, ease of insertion into the interior of an ink supply pipe 6, and excellent corrosion resistance against ink, being not deformed or denatured even by direct contact with ink. Herein, the material constituting the air retaining member is not limited to a metal such as stainless steel. Another material such as ceramic or a resin may be suitable for the formation, unless deformed even by direct contact with ink.

As shown in FIG. 4B, the air retaining member is preferably inserted in the vicinity of an inkjet head 4 in an ink supply pipe 6 one end of which is connected to the inkjet head.

Pressure variation produced in the ink supply pipe 6 of the upstream side from the insertion position can be reduced more effectively.

Specifically, it is preferable that the inkjet head can be reciprocated in a predetermined direction and the air retaining member is preferably inserted in a portion extending in a direction differing from the predetermined direction from one end in an ink supply pipe one end of which is connected to the inkjet head.

In the present embodiment, since the inkjet head can be reciprocated in the main scanning direction A (the horizontal direction), an air retaining member 20A is inserted in a third linear portion extending in the vertical direction differing from the main scanning direction A (the horizontal direction) in an ink supply pipe 6 one end of which is connected to the inkjet head 4.

In the ink supply system of the present embodiment, due to reciprocating movement (reciprocating scanning) of the main scanning direction A of the carriage 3 and movement of an ink supply pipe 6 with this reciprocating movement, pressure variation is produced with respect to an ink in this supply pipe. This pressure variation is produced in a second linear portion extending mainly in the main scanning direction A. Therefore, an air retaining member is inserted in a third linear portion extending in the vertical direction differing from the main scanning direction A and moving together with the carriage 3, whereby the pressure variation is transferred to the interior of the inkjet head 4 to effectively reduce the occurrence of a phenomenon impeding stable ink ejection.

Further, it is preferable that a fixing section to fix an ink supply pipe, one end of which is connected to an inkjet head, to the inkjet head or a mounting section to mount the inkjet head is provided and an air retaining member is inserted somewhere between one end of the ink supply pipe and a portion fixed by the fixing section. In the ink supply pipe located between the one end connected to the inkjet head and the fixing section, the motion thereof with the movement of the carriage 3 is regulated and vibration is inhibited, whereby pressure variation can be reduced more effectively.

In the present embodiment, the symbol 27 in FIG. 4B represents a fixing section to fix an ink supply pipe 6, one end of which is connected to the ink supply connecting section 60 of an inkjet head 4, to the inkjet head 4 in the state of being detachable. In the ink supply pipe 6 between the fixing section 27 and the ink supply connecting section 60, motion with the movement of the carriage 3 is regulated. Herein, the ink supply pipe 6 may be fixed to the carriage 3 which is a mounting section in which an inkjet head 4 is mounted.

A third linear portion moving together with the carriage 3 and extending in the vertical direction differing from the main scanning direction A is fixed by a fixing section 27. Between this fixing section 27 and one end, an air retaining member 20A is inserted.

Further, it is preferable that the air retaining member has a contact portion to be brought into contact with the inner surface of an ink supply pipe and at least one of the ink supply pipe and the air retaining member is constituted of a material deformable with insertion of the air retaining member. By this elastic deformation, the air retaining member can be easily inserted and held in the interior of the ink supply pipe.

In the present embodiment, a large diameter section 23 serving as a contact portion to be brought into contact with the inner surface of the ink supply pipe is provided and the air retaining member 20A is constituted of a metal such as stainless steel. The ink supply pipe 6 is constituted of a resin or an elastic body such as rubber which is extensible and contractible. The air retaining member 20A is inserted in the opening of the side connected to the ink supply connecting section 69 in the ink supply pipe 6 from the large diameter section 23 side to be held in the interior of the ink supply pipe 6. Since the ink supply pipe 6 exhibits elasticity, when the large diameter section 23 is inserted in the opening of the ink supply pipe 6, the opening is smoothly expanded and elastically deformed for easy insertion. And, the elasticity of the ink supply pipe 6 is restored, which then makes close contact with the outer circumferential surface of the large diameter section 23, whereby by the elasticity of the ink supply pipe 6, displacement of the air retaining member 20A in the axis direction of the ink supply pipe 6 can be regulated. Thereby, with no fixing groove provided for the ink supply pipe 6, the air retaining member 20A can be held simply and surely in the interior of the ink supply pipe.

In this manner, the tip of the large diameter section 23 is brought into pressure contact with one opening of the ink supply pipe 6 in which both end portions are open and an ink supply path is formed in the interior, preferably with the opening of the side connected to the ink supply connecting section 60. Using the pressure contact force, the air retaining member 20A is inserted in the interior of the ink supply pipe 6. Then, the ink supply pipe 6 is connected to the ink tank 5 and the ink supply connecting section 60.

Further, it is preferable that the air retaining member is provided with a large diameter section brought into contact with the inner surface of the ink supply pipe and a small diameter section having a smaller diameter than the large diameter section and a space is formed between the inner surface of the ink supply pipe and the small diameter section. Thereby, the air retaining member can be held by the large diameter section and also such a space can be more easily formed.

Herein, the inner diameter or outer diameter refers to the diameter when a given shape is circular, being equivalent to the diameter in which the area is converted into a circle when the shape is not circular. The shape of the ink supply pipe and the shape of the small diameter section and the large diameter section are not limited to a circle.

Still further, it is preferable that the air retaining member extends in the axis direction of the ink supply pipe and has a penetrated hole in which ink can be communicatively connected. The penetrated hole makes it possible to sufficiently supply ink to the inkjet head, In the present embodiment, the air retaining member 20A penetrates the end face of the large diameter section 23 and the end face of the small diameter section 24 and extends in the axis direction of the ink supply pope 6, employing a hollow cylindrical body having an almost circular cross-section shape in which a penetrated hole 25 where ink can be communicatively connected is formed.

Herein, the diameter d3 of the penetrated hole 25 may differ in the large diameter section 23 and the small diameter section 24 or may be the same in both sections. In the present embodiment, the diameter of the penetrated hole 25 of the large diameter section 23 is allowed to be larger than that of the penetrated hole 25 of the small diameter section 24 to realize more sufficient ink supply to the inkjet head 4.

Further, the space preferably has a circularly formed portion. Such a circular space makes it possible to efficiently utilize the space in the interior of the ink supply pipe.

In the present embodiment, the air retaining member 20A is provided with a large diameter section 23 whose outer circumferential surface makes contact with the inner circumferential surface of an ink supply pipe 6 and a small diameter section 24 which is integrally and coaxially formed with the large diameter section 23 to enable to retain air 21 in at least a part of a circular space 22 formed between the inner circumferential surface of the ink supply pipe 6 and the small diameter section. Thereby, air 21 is retained in at least a part of the circular space 22 formed around the axis direction of the ink supply pipe 6.

Still further, it is preferable that the face of the ink supply source side of the space is closed and the face of the pressure chamber side is open. Ink enters from the face being open on the pressure chamber side of the space. However, since the face of the ink supply source side of the space is closed with a dead end, air is sealed on the ink supply side of the space, whereby a space where no ink enters can be easily ensured. Since direct ink entering into the space from the upstream is blocked, the position of the space where air is retained corresponds to a portion where a small amount of the ink flows. Therefore, the outflow of air due to ink flow as observed conventionally can be inhibited and then pressure variation can be stably reduced. Namely, in an inkjet head of the conventional technology, in a normal usage state, ink is filled in a common ink chamber and at the same time, air is retained in an adjacent air chamber. During a maintenance operation to suction the ink from the nozzle, even air being been retained in the air chamber is also discharged and then replaced with the ink in some cases. In such a case, problems may be produced in which pressure variation cannot be absorbed and stable ejection is impaired.

In the present embodiment, the large diameter section 23 is present closer to the ink tank 5 side than the small diameter section 24 and closes the face of the ink tank 5 side of the space, whereby the face of the ink supply source side of the space can be more easily closed.

Further, in the posture during use of an inkjet recording device, the face of the ink supply source side is preferably located above the face of the pressure chamber side. Thereby, air retained in the upper portion of the space can be allowed to be difficult to move, and during suction of the ink from the nozzle in a maintenance process, the outflow of air from the space can be effectively prevented with a simple structure.

The inkjet recording device 1 of the present embodiment is almost horizontally installed and used. The face of the ink supply source side of a space 22 formed by the air retaining member 20A is closed and the face of the pressure chamber side is open, and at the same time, an ink supply pipe 6 in a portion of which the air retaining member is inserted is placed so as for its axis direction to be almost in the vertical direction upward from the ink supply connecting section 60 of the inkjet head 4. In this manner, in the posture during use of an inkjet recording device, the face of the side where the space 22 is closed is allowed to be located above the face of the side being open.

Specifically, in actual usage, an ink is supplied from the ink tank 5 and then the ink from the upstream of an ink supply pipe 6 is passed through a penetrated hole 25 to enter the ink supply path 59 of the ink supply connecting section 60. Further, the ink enters from the face of the side where the bottom side of the space 22 is open. However, since a dead end is created by the large diameter section 23, air 21 is sealed in the upper portion of the space 22, whereby a space where no ink enters is ensured.

Further, by the large diameter section 23 making contact with the inner circumferential surface of the ink supply pipe 6, direct ink entering from the upstream into the space 22 between the outer circumferential surface of the small diameter section 24 and the inner circumferential surface of the ink supply pipe 6 opposed to this outer circumferential surface is blocked. The ink flow during ink supply is passed through the penetrated ole 25, being in the direction from the top to the bottom. Therefore, the position of the space 22 to retain air 21 results in a portion where a small amount of the ink flows, whereby the outflow of air due to ink flow as observed conventionally can be inhibited and then pressure variation can be stably reduced.

In this manner, by the operation during initial ink introduction, in the state where air 21 is sealed in at least a part (the upper portion) of the space 22, the ink is filled up in the ink supply path from the ink tank 5 to the pressure chamber of inkjet head 4.

In actual usage, as shown in FIG. 4B, when the nozzle is located on the downside, an ink 26 is filled up to a predetermined height of the space 22 and in the upper potion thereof, air 21 is sealed.

When the channel cross-sectional area (the cross-sectional area of the cross-section perpendicular to the axis direction of an ink supply pipe) of the space 22 is allowed to be large, the volume of the space 22 becomes increased, whereby the amount of air 21 retained in the interior can be increased. Thereby, the function of reducing pressure variation can be enhanced. Further, the length L2 of the small diameter section 24 is allowed to be large, whereby air amount can be also increased. The volume of the space 22 needs only to be appropriately changed based on the magnitude of pressure variation to inhibit the position shifting (the volume variation) of the ink meniscus in the nozzle via pressure variation reduction.

Herein, the size of the air retaining member needs only to be appropriately determined based on the intended purpose and the inner diameter of an ink supply pipe. In an air retaining member 20A of one example of the present embodiment, when the inner diameter of an ink supply pipe is designated as D mm, for example, in the large diameter section 23, the outer diameter d1 is about D+0.1 mm-D+0.5 mm, the length L1 is about 1 mm-3 mm, and the diameter d3 of the penetrated hole 25 is about d1−1.0 mm-d1−0.5 mm; and in the sir rail diameter section 24, the outer diameter d2 is about d1−2.0 mm-d1−0.8 mm, the length L2 is about 2 mm-20 mm, and the diameter d3 of the penetrated hole 25 is about d2−1.0 mm-d2−0.5 mm.

Further, the air retaining member preferably has a taper portion gradually contracting from the large diameter section toward the ink supply source side. When the air retaining member is inserted in an in supply pipe, the large diameter section is not brought into contact with the inner surface of the ink supply pipe, resulting in being not caught, and thereby smooth insertion can be carried out.

In the present embodiment, the air retaining member 20A has a taper portion 28 gradually contracting from the large diameter section 23 toward the opposite direction of the small diameter section 24.

Further, the ink supply pipe preferably exhibits air permeability at least in a portion making contact with retained air. Thereby, in the gas-liquid interface M where air and ink are brought into contact together, the decrease of air due to dissolution of air into the ink can be compensated by air supplied to the space by penetrating the ink supply pipe exhibiting air permeability, and the absorption effect of pressure variation can be maintained for a long term with a simple structure.

In the present embodiment, the entire ink supply pipe 6 is constituted of a material exhibiting air permeability and the outside of the ink supply pipe 6 is in contact with the atmosphere. Further, the air permeability of the ink supply pipe is preferably 100(ml/m$^2$·24 h·atm)-1000(ml/m$^2$·24 h·atm). This air permeability can be determined in such a manner that He is passed through an ink supply pipe placed in a thermostatic bath of 40° C. and then air penetrating into the He is quantitated by being separated into oxygen and nitrogen using gas chromatography.

In view of air permeability, ink resistance, and elasticity, in the present embodiment, the ink supply pipe 6 employs a mono-layered or multi-layered tube made of a polymer resin material such as polyethylene, a fluorine resin, or nylon, but any appropriate rubber material may be used.

The thickness of the ink supply pipe 6 is preferably about 0.5 mm-2 mm in view of air permeability, elasticity, and strength.

A preferable inner diameter of the ink supply pipe 6 differs in some degree depending on the viscosity of a used ink and the ejection capability of an inkjet head. The inner diameter (the diameter) of the ink supply pipe 6 is preferably 1 mm-5 mm.

Further, the ink supply pipe is preferably transparent at least in a portion making contact with retained air. Detection whether or not air remains in the space can be carried out. Therefore, in the case where no air remains, a mechanism to newly inject air is provided (for example, a release valve is placed to inject air forcibly) or replacement with a fresh ink is made to reintroduce air, whereby the state where air surely remains can be maintained. Detection whether or not air remains may be carried out visually. Alternatively, a constitution to automatically carry out detection may be made in which for example, a mechanism to detect whether or not air remains via determination of the light transmittance of the space is provided. If no air has remained, air is just reintroduced, or the operator may be informed of such a matter.

In the present embodiment, the entire ink supply pipe 6 is constituted of a transparent material. Herein, "transparence" needs only to have the extent that air and ink can be distinguished, which can be realized by employing a mono-layered or multi-layered tube made of a polymer resin material as described above.

Second Embodiment

Figure 5B:
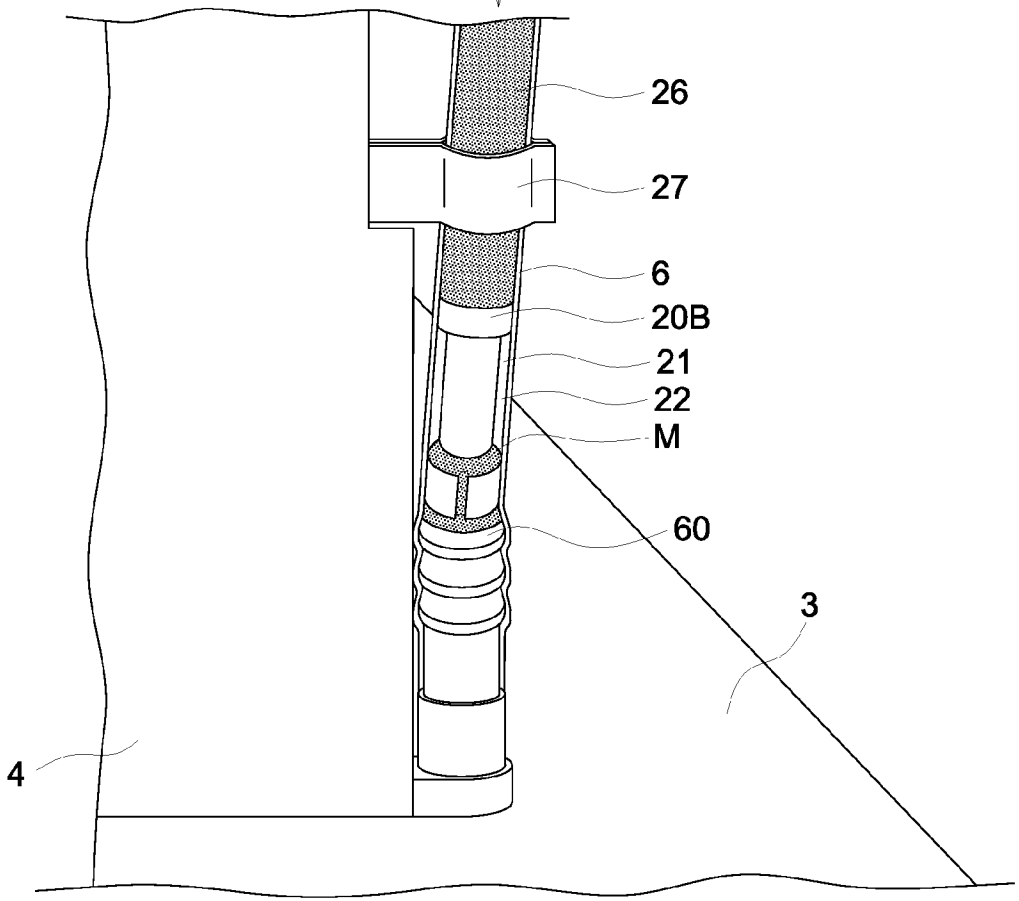
FIG. 5 is a schematic view of an air retaining member according to a second embodiment of the present invention, in which (a) is an enlarged perspective view and (b) is a perspective view showing the state where an inkjet supply pipe in which an air retaining member is inserted has been attached to an inkjet head.
Figure 5A:
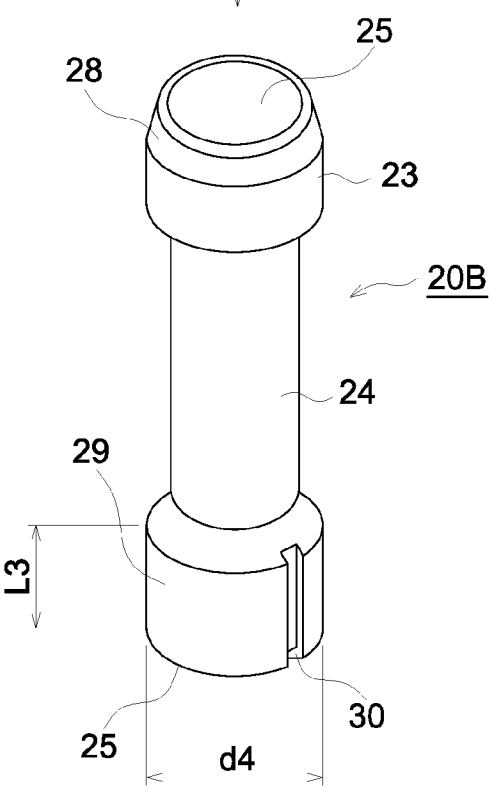

The inkjet recording device of the second embodiment differs from that of the first embodiment in which its constitution is made using an air retaining member 20B as shown in FIG. 5 instead of the air retaining member 20A of the first embodiment. Therefore, only the difference is described below.

In the second embodiment, a space 22 has a first area and a second area located closer to the inkjet head side (the pressure chamber side) than the first area with a channel cross-sectional area smaller than that of the first area.

As shown in FIG. 5, the air retaining member 20B of the second embodiment has a second large diameter section 29 located closer to the pressure chamber side than the small diameter section 24 and brought into contact with the inner surface of the ink supply pipe 6. The second large diameter section 29 has a groove 30 extending in the axis direction of the ink supply pipe 6 in a part of the outer circumferential surface making contact with the inner surface of the ink supply pipe 6. The first area is formed between the inner surface of the ink supply pipe 6 and the small diameter section 24, and between the same and the groove 30, the second area is formed. In the channel cross-sectional area (the cross-sectional area of the cross-section perpendicular to the axis direction of the ink supply pipe), the first area is larger than the second area.

The outer diameter d4 of the second large diameter section 29 is formed so as to be almost the same as the outer diameter d1 of the large diameter section 23.

In the inkjet recording device of the second embodiment having the above constitution, the channel resistance of this groove 30 makes it possible to prevent the contact of a fresh ink 26 having a low dissolved gas concentration having moved from the upstream of the ink supply pipe and air in the space 22. Namely, the ink 26 having entered the space 22 via the groove 30 remains without being replaced in the state where the dissolved gas concentration has been saturated, whereby in the gas-liquid interface M where this ink 26 and air 21 are brought into contact together, air decrease caused by dissolution of air 21 into the ink 26 can be inhibited.

Further, as described above, since in the state where the ink supply pipe 6 is expanded, an air retaining member is inserted, the ink supply pipe 6 in the vicinity where contact is made with the large diameter section 23 is opposed to the small diameter section 24 with a slight incline. Therefore, when the difference between the outer diameter d1 of the large diameter section 23 and the outer diameter d2 of the small diameter section is excessively small, or when the length of the small diameter section is large, the inner circumferential surface of the ink supply pipe is brought into contact with the outer circumferential surface of the small diameter section 24 and thereby formation of the gas-liquid interface M between the ink 26 and air 21 may be inhibited. However, in the present embodiment, the ink supply pipe is supported by the second large diameter section 29 in addition to the large diameter section 23, whereby with a simpler constitution, the occurrence of such contact can be prevented.

Incidentally, the size of the air retaining member needs only to be appropriately determined based on the intended purpose and the inner diameter of an ink supply pipe. In the air retaining member 20B of the second embodiment, when the inner diameter of the ink supply pipe is designated as D mm, for example, in the large diameter section 23, the outer diameter d1 is about D+0.1 mm-D+0.5 mm, the length L1 is about 1 mm-3 mm, and the diameter d3 of the penetrated hole 25 is about d1−1.0 mm-d1−0.5 mm; in the small diameter section 24, the outer diameter d2 is about d1−2.0-mm-d1−0.8 mm, the length L2 is about 2 mm-20 mm, and the diameter d3 of the penetrated hole 25 is about d2−1.0 mm-d2−0.5 mm; and in the second large diameter section 29, the outer diameter d4 is about D+0.1 mm-D+0.5 mm, the length L3 is about 1 mm-3 mm, the diameter d3 of the penetrated hole 25 is about d1−1.0 mm-d1−0.5 mm, the width of the groove 30 is about 0.2 mm-0.5 mm, and the depth is about 0.2 mm-0.5 mm.

Third Embodiment

Figure 6B:
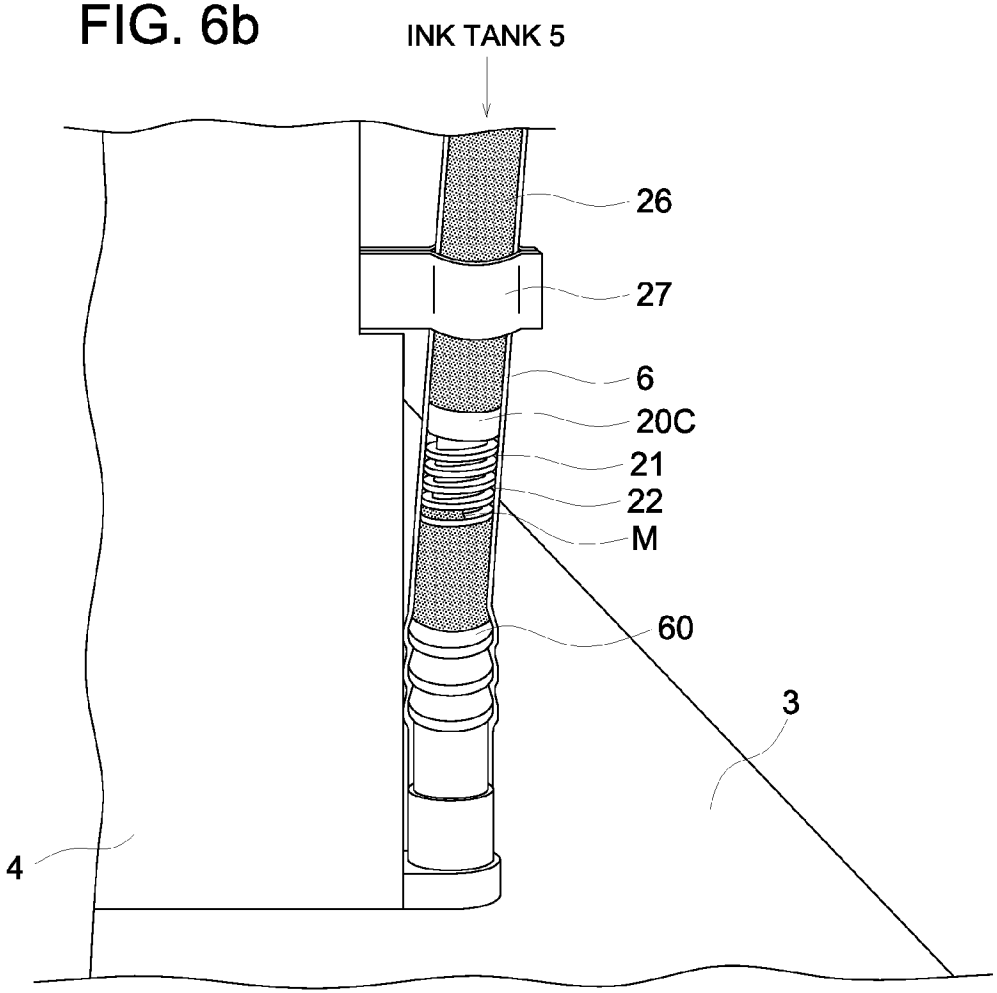
FIG. 6 is a schematic view of an air retaining member according to a third embodiment of the present invention, in which (a) is an enlarged perspective view and (b) is a perspective view showing the state where an inkjet supply pipe in which an air retaining member is inset led has been attached to an inkjet head.
Figure 6A:
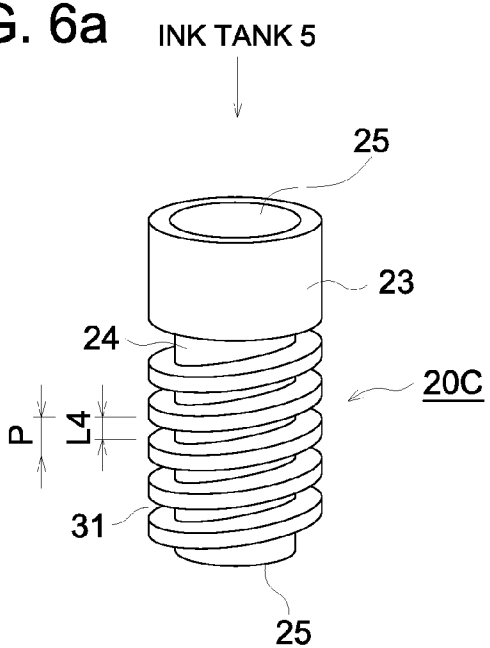

The inkjet recording device of the third embodiment differs from that of the first embodiment in which its constitution is made using an air retaining member 20C as shown in FIG. 6 instead of the air retaining member 20A of the first embodiment. Therefore, only the difference is described below.

In the third embodiment, a space 22 is spirally formed around the axis direction of an ink supply pipe.

In the air retaining member 20C of the third embodiment, as shown in FIG. 6, a spiral groove 31 extending in the axis direction of an ink supply pipe is formed in a part of the lower side of a hollow cylindrical body having a diameter equal to the diameter d1 of the large diameter section 23. Namely, the portion where no spiral groove 31 is formed corresponds to the large diameter section 23 making contact with the inner surface of the ink supply pipe and the bottom face of the spiral groove 31 corresponds to the small diameter section 24. A constitution is made so that air 21 is retained in at least a part of the space 22 between the spiral groove 31 and the inner surface of the ink supply pipe 6.

In the inkjet recording device of the third embodiment having the above constitution, via the channel resistance of this spiral groove 31, a fresh ink 26 having low dissolved gas concentration having moved from the upstream of the ink supply pipe and air 21 of the space 22 are prevented from being brought into contact together. Namely, the ink 26 having entered the space 22 via the spiral groove 31 remains in the state where the dissolved gas concentration is saturated without being replaced, whereby in the gas-liquid interface M where this ink 26 and air 21 are brought into contact together, air decrease caused by dissolution of air 21 into the ink 26 can be inhibited.

Further, a simple structure combined with a long and narrow channel makes it possible to regulate the free movement of air 21 in the space 22 and then inhibit the outflow of air 21. The channel is elongated, whereby the cross-sectional area of the channel can be reduced. Thereby, a predetermined air volume is maintained in the space 22 and also the contact area in the gas-liquid inter face M where air 21 and the ink 26 are brought into contact together can be reduced, whereby the rate of the air decrease caused by dissolution of air 21 into the ink 26 is decreased and thereby, the dissolution of air can be inhibited with a simple structure.

Incidentally, the meniscus holding force of the gas-liquid interface M is proportional to the surface tension of an ink and inversely proportional to the diameter of the gas-liquid interface (equivalent to the contact area). In the present embodiment, when the contact is allowed to be small, the meniscus holding force can be enhanced, whereby the gas-liquid interface tends not to move against vibration and inclination, resulting in a strong structure.

Further, in the present embodiment, an ink supply pipe is supported by a dividing wall to divide the spiral groove 31 together with the large diameter section 23, whereby with a simpler constitution, the ink supply pipe and the small diameter section can be prevented from being brought into contact together.

Incidentally, the size of this air retaining member needs only to be appropriately determined based on the intended purpose and the inner diameter of an ink supply pipe. In the air retaining member 20C of the third embodiment, when the inner diameter of the ink supply pipe is designated as D mm, for example, in the large diameter section 23, the outer diameter d1 is about D+0.1 mm-D+0.5 mm, the length L1 is about 1 mm-3 mm, and the diameter d3 of the penetrated hole 25 is about d1−1.0 mm-d1−0.5 mm; in the small diameter section 24, the outer diameter d2 is about d1−2.0 mm-d1−0.8 mm and the diameter d3 of the penetrated hole 25 is about d2−1.0 mm-d2−0.5 mm; and in the spiral groove 31, the width L4 is about 0.3 mm-1.0 mm and the pitch P is about 0.5 mm-2.0 mm.

Fourth Embodiment

Figure 7B:
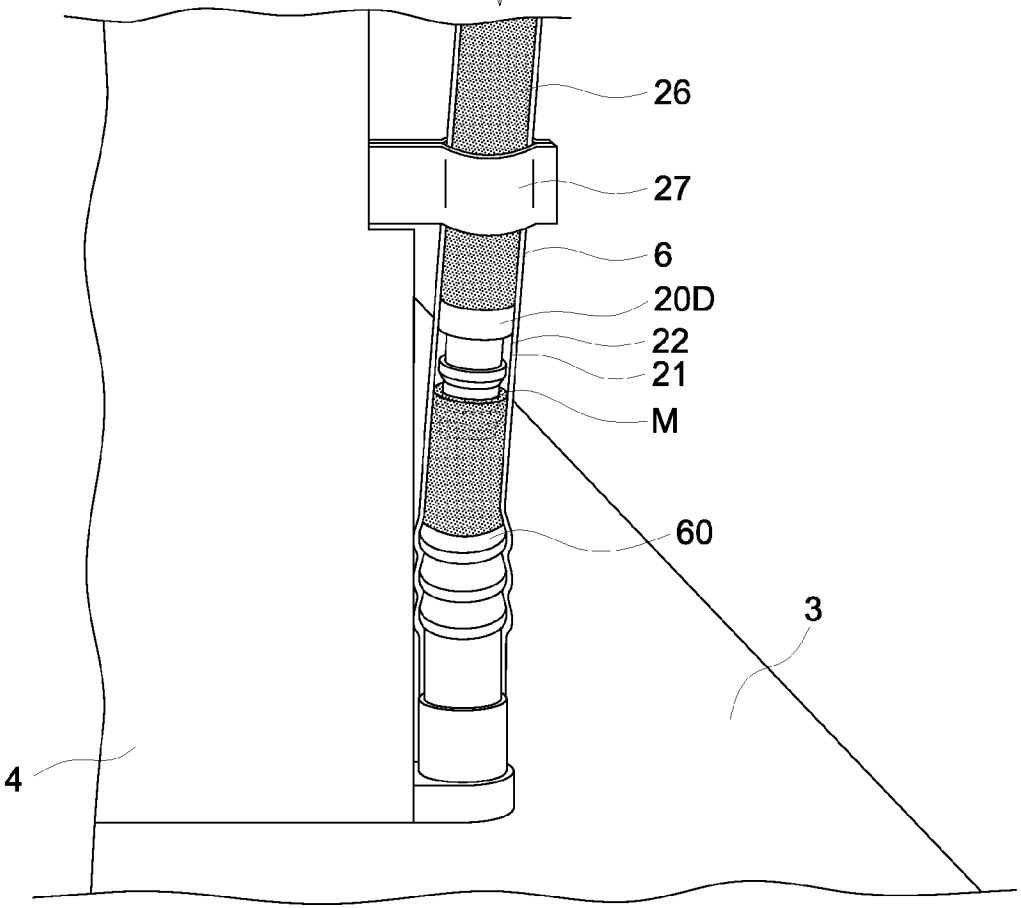
FIG. 7 is a schematic view of an air retaining member according to a fourth embodiment of the present invention, in which (a) is an enlarged perspective view and (b) is a perspective view showing the state where an inkjet supply pipe in which an air retaining member is inserted has been attached to an inkjet head.
Figure 7A:
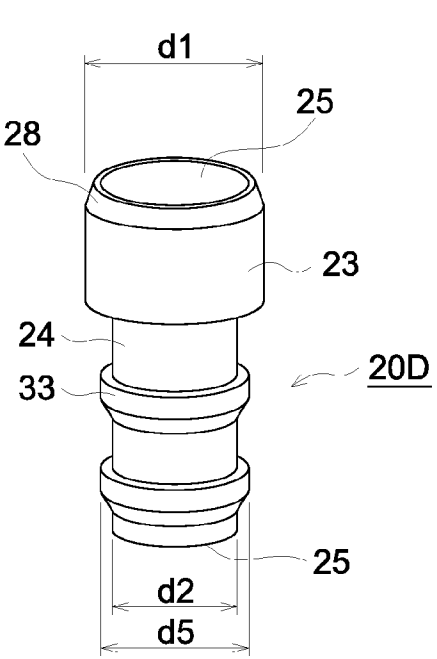

The inkjet recording device of the fourth embodiment differs from that of the first embodiment in which its constitution is made using an air retaining member 20D as shown in FIG. 7 instead of the air retaining member 20A of the first embodiment. Therefore, only the difference is described below.

In the fourth embodiment, a space 22 has a first area and a second area having small channel cross-sectional area located closer to the inkjet head side (the pressure chamber side) than the first area.

As shown in FIG. 7, the air retaining member 20D of the fourth embodiment has a large diameter section 23 making contact with the inner surface of an ink supply pipe and a small diameter section 24. The small diameter section 24 has a protrusion 33 protruding from the wall surface opposed to the inner surface of the ink supply pipe. The first area is formed between the inner surface of the ink supply pipe and the wall surface, and between the same and the protrusion 33, the second area is formed. In the channel cross-sectional area (the cross-sectional area of the cross-section perpendicular to the axis direction of the ink supply pipe), the first area is larger than the second area.

Herein, in the example of FIG. 7, in the axis direction of the ink supply pipe, 2 protrusions 33 separated with a predetermined distance are provided and then 2 sets of the first area and the second area are alternately formed. However, at least one set of the first area and the second area needs only to be formed.

In the inkjet recording device of the fourth embodiment having the above constitution, via the channel resistance of this protrusion 33, a fresh ink 26 having low dissolved gas concentration having moved from the upstream of the ink supply pipe and air 21 of the space 22 are prevented from being brought into contact together. Namely, the ink 26 having entered the space 22 via the second area formed by the protrusion 33 and the inner surface of the ink supply pipe remains in the state where the dissolved gas concentration is saturated without being replaced, whereby in the gas-liquid interface M where this ink 26 and air 21 are brought into contact together, air decrease caused by dissolution of air 21 into the ink 26 can be inhibited.

Incidentally, the size of the air retaining member needs only to be appropriately determined based on the intended purpose and the inner diameter of an ink supply pipe. In the air retaining member 20D of the fourth embodiment, when the inner diameter of the ink supply pipe is designated as D mm, for example, in the large diameter section 23, the outer diameter d1 is about D+0.1 mm-D+0.5 mm, the length L1 is about 1 mm-3 mm, and the diameter d3 of the penetrated hole 25 is about d1−1.0 mm-d1−0.5 mm; in the small diameter section 24, the outer diameter d2 is about d1−2.0 mm-d1−0.8 mm, the length L2 is about 2 mm-20 mm, and the diameter d3 of the penetrated hole 25 is about d2−1.0 mm-d2−0.5 mm; and in the protrusion 33, the outer diameter d5 is about d1−1.0 mm-d1−0.4 mm.

Fifth Embodiment

Next, modified embodiments in which the first-fourth embodiments are modified will now be described. Herein, the same symbols are assigned to those having the same constitutions and then description thereof will be appropriately omitted.

In the inkjet recording device of the fifth embodiment, as shown in FIG. 8, in the large diameter section 23 of an air retaining member 20E, a groove 70 communicatively connected to the space 22 is formed in the outer circumferential portion making contact with the inner surface of an ink supply pipe 6. Further, in the ink supply pipe 6, an atmospheric air communication hole 71 to allow the space 22 to be communicatively connected to the atmosphere via the groove 70 is formed in a position corresponding to the groove 70. Further, in the outer circumferential portion of the ink supply pipe 6, an opening and closing member 72 to open and close the atmospheric air communication hole 71 is provided. This groove 70 extends from the lower end of the large diameter section 23 to a part of the way leading to the upper end to introduce air introduced from the atmospheric air communication hole 71 into the upper portion of the space 22.

The ink supply pipe 6 is preferably constituted of a transparent material. Herein, "transparence" needs only to have the extent that air and ink can be distinguished, which can be realized by employing a mono-layered or multi-layered tube made of a polymer resin material as described above.

The opening and closing member 72 is constituted, for example, of an elastic member such as metal to urge the atmospheric air communication hole 71 to close in the state of being brought into contact with the outer circumferential portion of the ink supply pipe 6, being constituted so as to be movable in the axis direction of the ink supply pipe 6 between the atmosphere closing position (refer to FIG. 8A) in which the inner surface is opposed to the atmospheric air communication hole 71 to close the hole and the atmosphere opening position (refer to FIG. 8B), which is a position not opposed to the atmosphere opening position, namely to open the atmospheric air communication hole 71.

This opening and closing member 72 is integrally provided with a circularly-formed sealing section 72A making contact with the outer circumferential portion of an ink supply pipe 6 and an operating section 72B to allow the sealing section 72A to be brought into contact with and withdrawn from the ink supply pipe 6 via deformation toward the diameter direction outside. Thereby, the sealing section 72A and the outer circumferential portion of the ink supply pipe 6 are brought into close contact together with no space, and also in the state where the opening and closing member 72 is in the atmosphere closing position, the atmosphere is prevented from flowing from the atmospheric air communication hole 71 into the space 22. Further, in this state, an ink is prevented from leaking from the atmospheric air communication hole 71 by the sealing section 72A.

Subsequently, the opening and closing operation of the opening and closing member 72 will now be described.

Figure 8A:
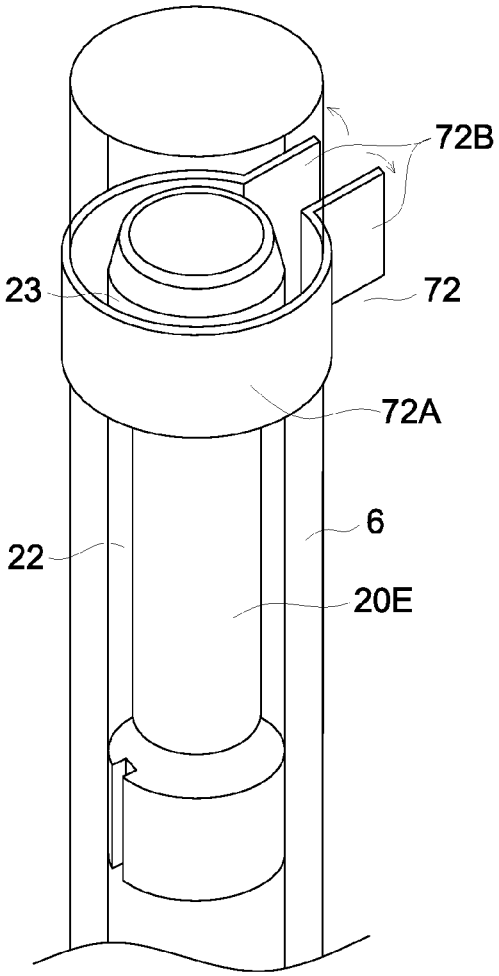
FIG. 8 is a schematic view of an air retaining member and an opening and closing member according to a fifth embodiment of the present invention, in which (a) is an enlarged perspective view showing the state where an atmospheric air communication hole has been closed and (b) is an enlarged perspective view showing the state where the atmospheric air communication hole has been opened.

Initially, as shown in FIG. 8A, in normal usage, that is, when no air needs to be introduced into the space 22, the opening and closing member 72 is located at the atmosphere closing position to close the atmospheric air communication hole 71. By the urging force of an elastic member, the sealing section 72A is urged toward the diameter direction inside and the sealing section 72A is in contact with the outer circumferential portion of the ink supply pipe 6, whereby the atmosphere communicatively connection hole 71 is closed.

Figure 8B:
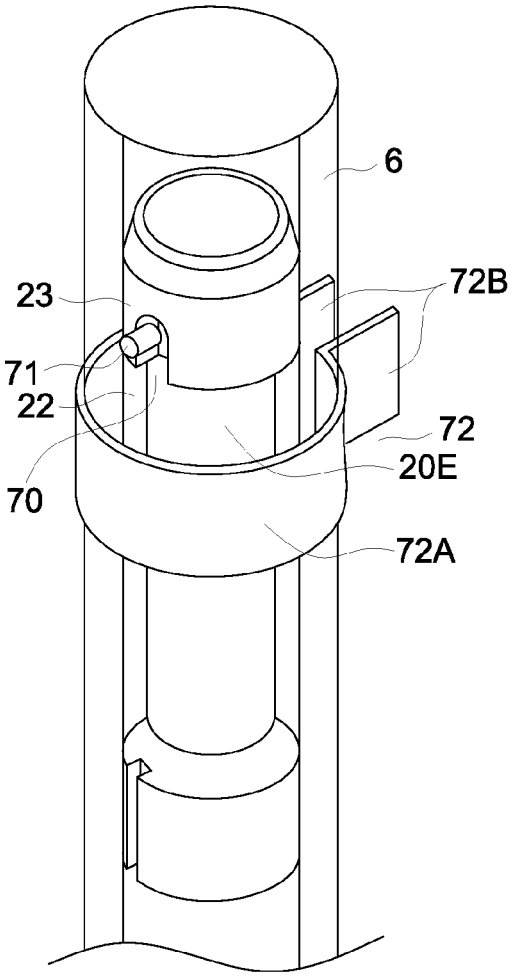

Then, when air is introduced into the space 22, the operating section 72B of the opening and closing section 72 is pushed outward as shown by the arrows of FIG. 8A and thereby the sealing section 72A is elastically defaulted toward the diameter direction outside against the urging force to be withdrawn from the ink supply pipe 6. Then, the opening and closing member 71 is moved downward. At this moment, as shown in FIG. 8B, since the opening and closing member 72 is moved from the atmosphere closing position of FIG. 8A to the atmosphere opening position of FIG. 8B, the atmospheric air communication hole 71 is communicatively connected to the atmosphere in the outside. Namely, as shown in FIG. 8B, the atmospheric air communication hole 71 is allowed to be open and then air in the outside is introduced into the space 22 via the groove 70.

The back pressure of an ink in the nozzle of the inkjet head is appropriately set to be negative, whereby during communicative connection with the atmosphere, the pressure difference between the space 22 attempting to be in atmospheric pressure and the nozzle interior having negative pressure makes it possible that air of the outside is easily suctioned into the space 22.

According to the inkjet recording device described above, when no air 21 in the space 22 has existed, the opening and closing member 72 is manually or automatically moved upward or downward to open the atmospheric air communication hole 71, whereby air is replenished simply and quickly. In the automatic operation, a detection member of the residual amount of air is provided and then, the opening and closing member is allowed to move in response to the detection operation to open the atmosphere communicatively connecting hole.

Further, since the atmospheric air communication hole 71 of an ink supply pipe 6 can be opened and closed by the opening and closing member 72, the number of parts can be reduced to simplify the structure, and also production cost reduction can be realized.

Still further, when an opening and closing member 72 is in the atmosphere closing position, the large diameter section 23 subjected to the urging force of this opening and closing member is located inside an ink supply pipe 6. Thereby, the ink supply pipe 6 needs not to have such a strength level that no deformation is produced against the urging force of the opening and closing member 72. Therefore, the ink supply pipe 6 can employ a mono-layered or multi-layered tube made of a relatively flexible polymer resin material, which is advantageous in detection of the residual air.

Figure 9A:
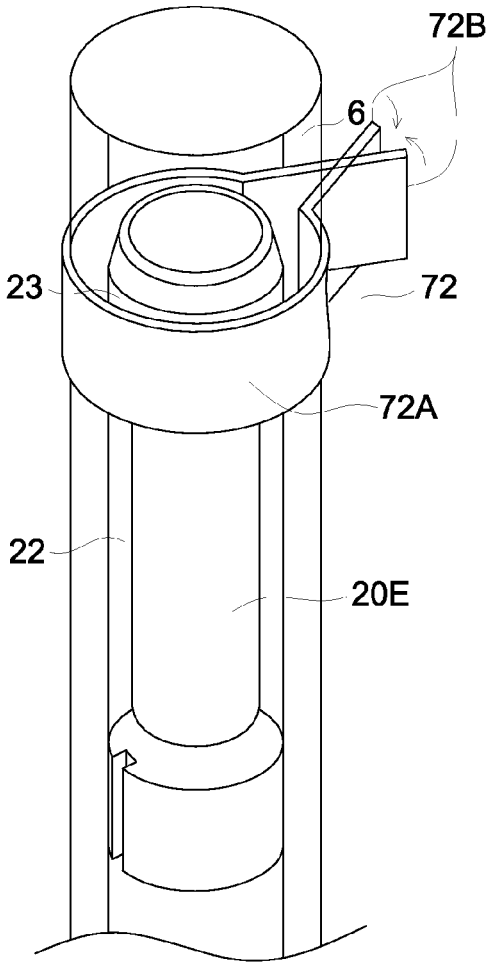
FIG. 9 is a schematic view of an sir retaining member and an opening and closing member according to a modified example of the fifth embodiment of the present invention, in which (a) is an enlarged perspective view showing the state where an atmospheric air communication hole has been closed and (b) is an enlarged perspective view showing the state where the atmospheric air communication hole has been opened.
Figure 9B:
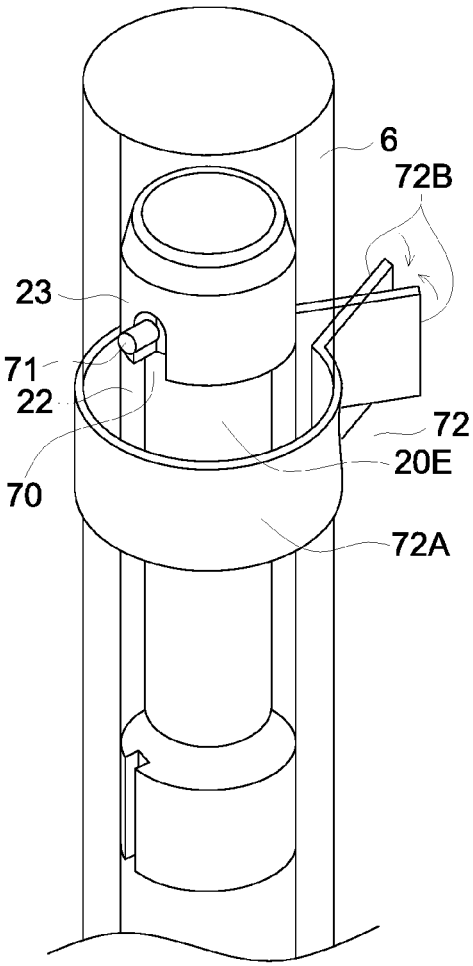

The opening and closing member 72 can be constituted of an elastic member such as a metal of the embodiments, as well as a member such as synthetic rubber having elasticity. Herein, in this embodiment, the operating section 72B is pushed outward and thereby the sealing section 72A can be elastically deformed toward the diameter direction outside. However, it is possible that as shown in FIG. 9, an operating section 72B is constituted so as to intersect, and then the operating section 72B is pushed as shown by the arrows of FIG. 9A to be elastically deformed.

When the atmosphere communicatively connection hole 71 is opened, this method is not limited to a method to move an opening and closing member 72 upward or downward. The sealing section 72A may be elastically deformed toward the diameter direction outside and withdrawn from the ink supply pipe 6 for opening.

In the embodiment, one groove 70 and one atmospheric air communication hole 71 are provided. However, the numbers thereof are not specifically limited.

Sixth Embodiment

Figure 10A:
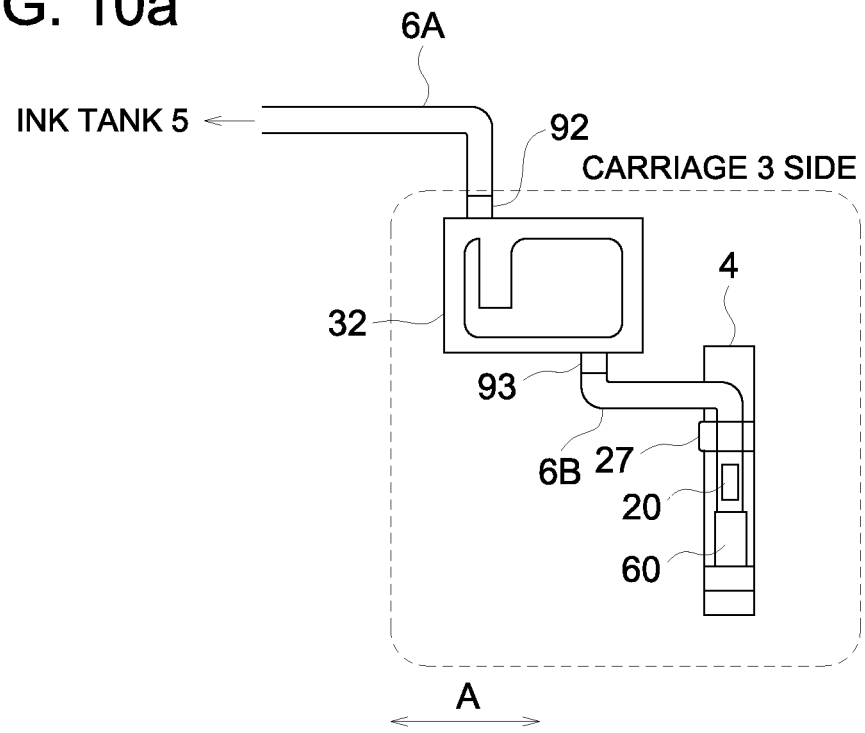
FIG. 10 includes (a) a schematic view of an ink supply system according to a sixth embodiment of the present invention and (b) a perspective view showing one example of a damper.

The inkjet recording device of the sixth embodiment differs from those of the first-fifth embodiments in which its constitution is made using an ink supply system as shown in FIG. 10A instead of the ink supply system of each of the first-fifth embodiments. Therefore, only the difference is described below.

As shown in FIG. 10A, the ink supply system of the sixth embodiment has a damper 32 having a reservoir to temporarily accumulate an ink placed on the way of the ink supply path from an ink tank 5 to store the ink to an inkjet head 4 and a damper film exhibiting fixability placed on at least one side of the reservoir; an ink supply pipe 6A which is an ink supply path ranging from the ink tank 5 to the damper 32; and an ink supply pipe 6B which is an ink supply path ranging from the damper 32 to the inkjet head 4. An air retaining member 20 (for example, any of the air retaining members 20A-20E) is inserted in the interior of the ink supply pipe 6B.

Figure 10B:
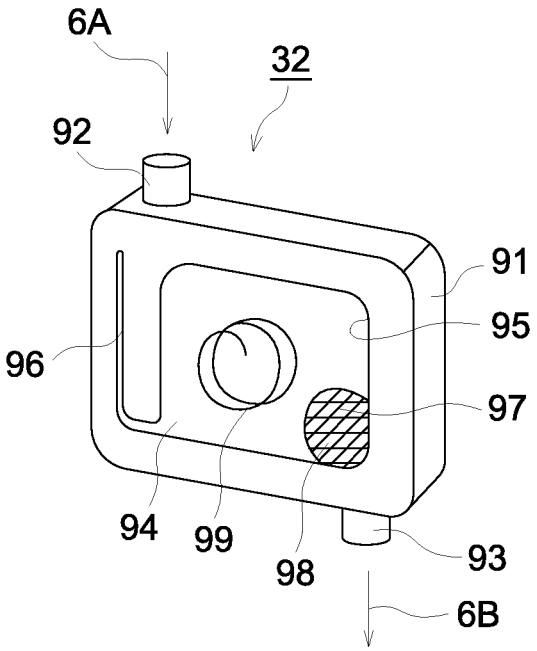

The damper 32 is placed, for example, in a second linear portion extending in the main scanning direction A to be mounted in a carriage 3, and as shown in FIG. 10B, provided with a reservoir 91 to temporarily accumulate an ink, an introducing section 92 connected to an ink supply pipe 6A in the upper portion of the reservoir 91 to introduce the ink into the reservoir 91, and a discharging section 93 connected to an ink supply pipe 6B in the lower portion of the reservoir 91 to discharge the ink inside the reservoir 91.

On one side of the reservoir 91, a damper film 94 is tightly stretched. The damper film 94 is made, for example, of a flexible film such as polyethylene film. For example, via heat film welding on one side, a depressed portion 95 where an ink is accumulated is sealed. Herein, the material of the film exhibiting flexibility constituting the damper film 94 is not limited to the above-exemplified one. However, since some inks used for image recording exhibit corrosive properties, at least for a portion directly making contact with an ink, a material having corrosion resistance is desirably used so that the damper film 94 is not degraded by the ink accumulated inside the reservoir 91.

On the inside of the damper 94, a depressed portion 95 to accumulate an ink is formed. From the lower portion of this depressed portion 95, a groove 96 to allow the depressed portion 95 and the introducing section 92 to be communicatively connected together is formed toward the introducing section 92. Further, on the opposite side of the groove 96 in the lower portion of the depressed portion 95, a communicatively connecting opening 97 to allow the depressed portion 95 and the discharging section 93 to be communicatively connected together is placed. To this communicatively connecting opening 97, a filter 98 is attached so that no dirt contained in an ink or cured ink flows out. Further, in the center of the depressed portion 95, a spring 99 providing a predetermined tension for the damper film 94 is placed. Namely, an ink having flowed into the damper 32 from the introducing section 92 reaches the depressed portion 95 via the groove 96 to be temporarily stored therein. At this moment, the pressure variation of the ink having been accumulated in the depressed portion 95 is absorbed with the tension variation of the damper film 94. Thereafter, the ink is ejected from the inkjet head 4 and thereby the inkjet head 4 interior and the ink channel of the ink supply pipe 6B of the downstream side of the damper 32 have negative pressure and then the ink having been accumulated in the depressed portion 95 flows out from the discharging section 93.

When the ink has flowed in (out from) the interior of the damper 32, a damper film having flexibility bends outward (inward), whereby an increase (decrease) in ink pressure due to the inflow of the ink can be absorbed. Thereby, differently from the case of a damper having a constitution in which the pressure of the ink is absorbed by air in the air chamber, large pressure variation can be absorbed. Therefore, even when a large damper effect is required, the pressure variation of the ink can be sufficiently reduced.

However, the method to place a damper 32 in the ink supply path produces a certain effect, but as the scanning rate of the carriage is increased, the damper is allowed to have a larger shape to enhance the absorption ability of the damper with respect to the pressure variation.

For this reason, arrangement of a large damper in the vicinity of the inkjet head produces a problem in which it is difficult to realize the design of an inkjet recording device. Further, to arrange a damper on the carriage, dampers whose number corresponds to that of inkjet heads need to be mounted, which results in the size and weight increase of the carriage. As a result, the size and weight of the entire device are increased. Further, to drive such a large-size carriage, problems are produced in which the drive system of the carriage needs to be powered up and also an increase in device cost results. Therefore, in designing of an inkjet recording device, a damper is allowed not to be arranged on the carriage but needs to be arranged in a location distant from the inkjet head in some cases.

In any case, the damper 32 and the inkjet head 4 are required to separate from each other to some extent and between the both, an ink supply pipe is required. When such an ink supply pipe exists, a problem in which due to mechanical vibration and acceleration/deceleration, ink supply pressure varies to a minor extent is noted. Therefore, to prevent such a minor pressure variation, an air retaining member 20 is inserted in the interior of an ink supply pipe 6B which is the ink supply path from the damper 32 to the inkjet head 4.

Further, in the above first-fifth embodiments, no damper 32 is provided but an air retaining member is inserted in the interior of an ink supply pipe. In the case of such a constitution, compared with the case where a damper 32 is provided, the absorption capability of the damper with respect to pressure variation tends to be decreased. In the cases of a serial system having small scanning rate and a line system to carry out recording in which an inkjet head is allowed to stand still to be described later, pressure variation can be sufficiently absorbed. However, in the case where large pressure variation occurs as observed in the case of a serial system having large scanning rate, in the absorption capability of the damper with respect to the pressure variation, a large damper 32 is preferably combined.

In this manner, in addition to a damper having an adequate capability to realise a large damper effect, an air retaining member 20 is provided, whereby the effect to absorb the pressure variation can be increased more simply.

As described above, in the inkjet recording device 1 of the present embodiment, in the interior of an ink supply pipe, an air retaining member is inserted in the state where an ink can be communicatively connected, and a space 22 enabling to retain air is formed between the inner surface of the ink supply pipe 6 and the air retaining member, whereby air 21 retained in at least a part of the space 22 makes it possible to reduce the variation of the supply pressure of an ink due to exterior vibration resulting from a motor and a pump and carriage scanning to enhance ejection stability, and also the air retaining member needs only to be inserted in the ink supply pipe. The ink supply pipe and the inkjet head can be employed as such, and thereby with no large constitutional change of an inkjet recording device, a space 22 can be provided simply and at reduced cost.

Further, in the above-described conventional technology, when the ink supply path for the inkjet head is provided with an air chamber, the shape of the ink supply path itself has been devised or an air chamber branched from the ink supply path has been provided, resulting in inefficient space utilization.

Further, there can be inkjet recording devices having a constitution with an air chamber and with no air chamber. When the shape of an ink supply path itself is devised and an air chamber branched from the ink supply path is provided, the difference from the inkjet recording device having a constitution with no air chamber is increased. Therefore, since it is difficult that an inkjet recording device having a constitution with an air chamber and an inkjet recording device with no air chamber are produced in a common production process, separate production processes therefor are required, resulting in increased cost.

Further, an ink supply pipe is used as such and then an air retaining member is just inserted therein, resulting in compactness and reduced cost. And also, for example, for separate inkjet recording devices having specifications in which the inner diameters of ink supply pipes differ, air retaining members differing in outer diameter need only to be produced corresponding to each. Therefore, design change is easy to carry out and no complicated production process is required.

An air retaining chamber is just inserted in an ink supply pipe, being therefore easily detachable.

Furthermore, the amount of retained air is set based on the outer diameter and length of the small diameter section of an air retaining member. Therefore, air retaining members differing in the outer diameter or length of the small diameter section are supplied for a single ink supply pipe, whereby the amount of air can be easily changed. Therefore, depending on the change of the amount of air, the ink supply pie and the inkjet head need not to be changed in each case, resulting in reduced cost.

In the above embodiments, shown are examples in which an air retaining member is inserted in an ink supply pipe connected to an inkjet head. However, in the present invention, it is only necessary to supply an ink from an ink supply source to the pressure chamber of the inkjet head and also to insert an air retaining member in an ink supply pipe in the ink channel at least a part of which is constituted of the ink supply pipe. For example, an air retaining member may be inserted in an ink supply connecting section 60 of the inkjet head.

Further, in the embodiments, for one ink supply pipe 6, one air retaining member 20A is provided, but the numbers thereof are not specifically limited.

Further, in the embodiments, applications were made to an inkjet recording device provided with only a main ink tank but can be also made to an inkjet recording device provided with a sub-tank.

Further, in the embodiments, applications were made to a serial-system inkjet recording device but can be also made to a line-system inkjet recording device. Even in the case of a line system carrying out recording in the state where the inkjet head is allowed to stand still, due to the influence of exterior vibration resulting from a pump and a motor, ink supply pressure may vary. According to the inkjet recording device of the present invention, the variation of the supply pressure of an ink can be reduced and then ejection stability can be enhanced.

Further, in the embodiments, the constitution of the inkjet head is not limited to a constitution in which the head chip is provided with a piezoelectric element. For example, a constitution in which a heater is provided may be employed.

Furthermore, the shape and the position relationship of the air retaining member can be appropriately changed for applications. For example, various combinations of the circular portion, groove portion, spiral portion, and protrusion of a space formed in the individual embodiments can be employed. As one example, a constitution, in which a circular portion is provided for the ink supply source side and a spiral portion is provided for the pressure chamber side, can be also employed.

DESCRIPTION OF THE SYMBOLS

1: inkjet recording device
4: inkjet head
6: ink supply pipe
20: air retaining member
41: head chip (inkjet head chip)
41S: ejection surface
48*a* and 48*b*: manifolds
P: recording medium
X: nozzle line direction

The invention claimed is:

1. An inkjet recording device comprising:

an inkjet head to eject an ink in a pressure chamber;

an ink supply path to supply the ink from an ink supply source to the pressure chamber of the inkjet head, wherein at least a part of the ink supply path comprises an ink supply pipe; and an air retaining member configured to be inserted in an interior of the ink supply pipe in a state in which the ink can be communicatively connected, to retain air in at least a part of a space formed between an inner surface of the ink supply pipe and the air retaining member;

wherein the air retaining member comprises a contact portion for making contact with the inner surface of the ink supply pipe;

wherein a groove portion communicatively connected to the space is formed in the contact portion;

wherein an atmospheric air communication hole to communicatively connect the space to the atmosphere via the groove portion is formed at a position corresponding to the groove portion in the ink supply pipe; and wherein the inkjet recording device further comprises an opening and closing member for opening and closing the atmospheric air communication hole.

2. An inkjet recording device comprising:

an inkjet head to eject an ink in a pressure chamber;

an ink supply path to supply the ink from an ink supply source to the pressure chamber of the inkjet head, wherein at least a part of the ink supply path comprises an ink supply pipe, and wherein the ink supply pipe comprises an elastic body; and an air retaining member configured to be inserted in an interior of the ink supply pipe in a state in which the ink can be communicatively connected, to retain air in at least a part of a space formed between an inner surface of the ink supply pipe and the air retaining member;

wherein the space includes a first area and a second area; and wherein the second area is located closer to a pressure chamber side than the first area and has a smaller channel cross-sectional area than the first area.

3. An inkjet recording device comprising:

an inkjet head to eject an ink in a pressure chamber;

an ink supply path to supply the ink from an ink supply source to the pressure chamber of the inkjet head, wherein at least a part of the ink supply path comprises an ink supply pipe, and wherein the ink supply pipe comprises an elastic body; and an air retaining member configured to be inserted in an interior of the ink supply pipe in a state in which the ink can be communicatively connected, to retain air in at least a part of a space formed between an inner surface of the ink supply pipe and the air retaining member;

wherein the air retaining member comprises a large diameter section that makes contact with the inner surface of the ink supply pipe and a small diameter section having a smaller diameter than the large diameter section, and wherein the space is formed between the inner surface of the ink supply pipe and the small diameter section.

4. The inkjet recording device described in claim 3, wherein the large diameter section is located closer to the ink supply source than the small diameter section and closes a face of an ink supply source side of the space.

5. The inkjet recording device described in claim 4, wherein the air retaining member further comprises another large diameter section which is located closer to a pressure chamber side than the small diameter section and which makes contact with the inner surface of the ink supply pipe;

wherein a part of a surface of the said another large diameter section making contact with the inner surface of the ink supply pipe is provided with a groove portion extending in an axis direction of the ink supply pipe; and wherein a first area is formed between the inner surface of the ink supply pipe and the small diameter section and a second area is formed between the inner surface of the ink supply pipe and the groove portion.

6. The inkjet recording device described in claim 3, wherein the small diameter section is provided with a protrusion protruding from a wall surface thereof which is opposed to the inner surface of the ink supply pipe;

wherein a first area is formed between the inner surface of the ink supply pipe and the wall surface; and wherein a second area is formed between the inner surface of the ink supply pipe and the protrusion.

7. The inkjet recording device described in claim 3, wherein the air retaining member comprises a taper portion gradually contracting from the large diameter section toward an ink supply source side.

8. The inkjet recording device described in claim 3, wherein the air retaining member is inserted in a vicinity of the inkjet head in the ink supply pipe, and one end of the ink supply pipe is connected to the inkjet head.

9. The inkjet recording device described in claim 8, wherein the inkjet head is reciprocable in a predetermined direction; and wherein the air retaining member is inserted in a portion of the ink supply pipe, the portion of the ink supply pipe extending from said one end in a direction different from the predetermined direction.

10. The inkjet recording device described in claim 8, further comprising a fixing section for fixing a portion of the ink supply pipe to the inkjet head or to a mounting section in which the inkjet head is mounted;

wherein the air retaining member is inserted in the ink supply pipe between said one end and the portion fixed by the fixing section.

11. The inkjet recording device described in claim 1, further comprising:

a damper having a reservoir provided in the ink supply path to temporarily accumulate the ink; and a flexible damper film provided for at least one side of the reservoir, wherein the air retaining member is inserted in the interior of the ink supply pipe to supply the ink from the damper to the pressure chamber of the inkjet head.

12. The inkjet recording device described in claim 1, wherein the air retaining member is inserted in a vicinity of the inkjet head in the ink supply pipe, and one end of the ink supply pipe is connected to the inkjet head.

13. The inkjet recording device described in claim 12, wherein the inkjet head is reciprocable in a predetermined direction; and wherein the air retaining member is inserted in a portion of the ink supply pipe, the portion of the ink supply pipe extending from said one end in a direction different from the predetermined direction.

14. The inkjet recording device described in claim 12, further comprising a fixing section for fixing a portion of the ink supply pipe to the inkjet head or to a mounting section in which the inkjet head is mounted;

wherein the air retaining member is inserted in the ink supply pipe between said one end and the portion fixed by the fixing section.

15. The inkjet recording device described in claim 2, wherein the air retaining member is inserted in a vicinity of the inkjet head in the ink supply pipe, and one end of the ink supply pipe is connected to the inkjet head.

16. The inkjet recording device described in claim 15, wherein the inkjet head is reciprocable in a predetermined direction; and wherein the air retaining member is inserted in a portion of the ink supply pipe, the portion of the ink supply pipe extending from said one end in a direction different from the predetermined direction.

17. The inkjet recording device described in claim 15, further comprising a fixing section for fixing a portion of the ink supply pipe to the inkjet head or to a mounting section in which the inkjet head is mounted;

wherein the air retaining member is inserted in the ink supply pipe between said one end and the portion fixed by the fixing section.

* * * * *